US009510100B2

(12) United States Patent
Shinotsuka et al.

(10) Patent No.: US 9,510,100 B2
(45) Date of Patent: Nov. 29, 2016

(54) ENERGY CONVERTER, SPEAKER, AND METHOD OF MANUFACTURING ENERGY CONVERTER

(71) Applicants: Michiaki Shinotsuka, Kanagawa (JP); Tsutomu Kawase, Kanagawa (JP)

(72) Inventors: Michiaki Shinotsuka, Kanagawa (JP); Tsutomu Kawase, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/469,712

(22) Filed: Aug. 27, 2014

(65) Prior Publication Data

US 2015/0071483 A1 Mar. 12, 2015

(30) Foreign Application Priority Data

Sep. 12, 2013 (JP) ..... 2013-189112
Jan. 31, 2014 (JP) ..... 2014-016415
Apr. 8, 2014 (JP) ..... 2014-079143

(51) Int. Cl.

| | |
|---|---|
| ***H04R 9/02*** | (2006.01) |
| ***H04R 31/00*** | (2006.01) |
| ***H04R 7/00*** | (2006.01) |
| ***H04R 9/00*** | (2006.01) |
| ***H04R 9/04*** | (2006.01) |

(52) U.S. Cl.

CPC *H04R 9/02* (2013.01); *H04R 7/00* (2013.01); *H04R 9/00* (2013.01); *H04R 9/04* (2013.01); *H04R 31/00* (2013.01); *Y10T 29/49005* (2015.01)

(58) Field of Classification Search

CPC ..... H04R 2440/00–2440/07; H04R 1/08; H04R 9/08; H04R 11/04; H04R 17/02; H04R 21/02; H04R 2217/00–2217/03; H04R 19/00–19/01; H04R 19/013; H04R 19/016; H04R 9/048

USPC ..... 381/152, 176–177, 190–191, 396, 399, 381/430, 432

See application file for complete search history.

(56) References Cited

U.S. PATENT DOCUMENTS

| | | | | |
|---|---|---|---|---|
| 5,003,610 | A | 3/1991 | Adachi et al. | |
| 5,195,143 | A * | 3/1993 | Spiegel et al. | 381/399 |
| 5,627,903 | A * | 5/1997 | Porrazzo et al. | 381/423 |
| 6,008,714 | A * | 12/1999 | Okuda et al. | 336/200 |
| 6,154,557 | A * | 11/2000 | Montour et al. | 381/431 |
| 6,480,614 | B1 * | 11/2002 | Denda et al. | 381/423 |
| 6,535,612 | B1 * | 3/2003 | Croft et al. | 381/191 |
| 7,152,299 | B2 * | 12/2006 | Mango et al. | 29/594 |
| 7,174,024 | B1 * | 2/2007 | Suzuki et al. | 381/152 |

(Continued)

FOREIGN PATENT DOCUMENTS

| | | |
|---|---|---|
| GB | 249062 | 4/1926 |
| GB | 295057 | 8/1928 |

(Continued)

OTHER PUBLICATIONS

U.S. Appl. No. 14/295,450, filed Jun. 4, 2014.

(Continued)

*Primary Examiner* — Suhan Ni

(74) *Attorney, Agent, or Firm* — Harness, Dickey & Pierce, P.L.C.

(57) ABSTRACT

An energy converter includes a permanent magnet and a diaphragm. The permanent magnet is fixed to a predetermined area. The diaphragm is disposed on the permanent magnet and has a coil formed of a conductor pattern.

17 Claims, 37 Drawing Sheets

(56) References Cited

U.S. PATENT DOCUMENTS

| | | | | |
|---|---|---|---|---|
| 2002/0126867 | A1 | 9/2002 | Aizik | |
| 2003/0194106 | A1 | 10/2003 | Tsuda et al. | |
| 2004/0234096 | A1 | 11/2004 | Tsuda | |
| 2005/0225951 | A1* | 10/2005 | Kurakami | H05K 5/02 361/749 |
| 2009/0316937 | A1* | 12/2009 | Zheng | H04R 19/00 381/182 |

FOREIGN PATENT DOCUMENTS

| | | |
|---|---|---|
| JP | 2005-151405 | 6/2005 |
| JP | 2010-251816 | 11/2010 |

OTHER PUBLICATIONS

European extended Search Report dated Mar. 4, 2015 for corresponding EP Application No. 14181210.

* cited by examiner

ENERGY CONVERTER, SPEAKER, AND METHOD OF MANUFACTURING ENERGY CONVERTER

CROSS-REFERENCE TO RELATED APPLICATIONS

This patent application is based on and claims priority pursuant to 35 U.S.C. §119(a) to Japanese Patent Application No. 2013-189112, filed on Sep. 12, 2013, in the Japan Patent Office, Japanese Patent Application No. 2014-016415, filed on Jan. 31, 2014, in the Japan Patent Office, Japanese Patent Application No. 2014-079143, filed on Apr. 8, 2014, in the Japan Patent Office, the entire disclosures of which are hereby incorporated by reference herein.

BACKGROUND

1. Technical Field

This disclosure relates to an energy converter and a speaker that interconvert electrical and mechanical energy, and a method of manufacturing the energy converter.

2. Related Art

Energy converters that interconvert electrical and mechanical energy include speakers and microphones. In a speaker, a coil adjacent to a permanent magnet is vibrated by repulsive force due to electromagnetic induction, causing a diaphragm fixed to the coil to vibrate the air and generate acoustic waves. In a microphone, acoustic waves vibrate a diaphragm, causing a current to flow through a coil connected with the diaphragm owing to electromagnetic induction.

In the past, speakers equipped with a conical diaphragm have been dominant. In recent years, however, thin speakers (so-called flat speakers) equipped with a flat planar diaphragm have been drawing attention.

SUMMARY

In one embodiment of this disclosure, there is provided an improved energy converter that, in one example, includes a permanent magnet and a diaphragm. The permanent magnet is fixed to a predetermined area. The diaphragm is disposed on the permanent magnet and has a coil formed of a conductor pattern.

In one embodiment of this disclosure, there is provided an improved speaker that, in one example, includes the above-described permanent magnet and the above-described diaphragm.

In one embodiment of this disclosure, there is provided an improved method of manufacturing an energy converter that, in one example, includes fixing a permanent magnet to a predetermined area, and disposing on the permanent magnet a diaphragm having a coil formed of a conductor pattern. The disposing includes placing a magnetic sheet encapsulated with a magnetic fluid on the diaphragm to visualize a magnetization pattern of the permanent magnet disposed under the diaphragm as a shading pattern of the magnetic fluid, and adjusting the diaphragm in position and disposing the diaphragm at a position at which the shading pattern matches the conductor pattern of the coil.

BRIEF DESCRIPTION OF THE DRAWINGS

A more complete appreciation of this disclosure and many of the advantages thereof are obtained as the same becomes better understood by reference to the following detailed description when considered in connection with the accompanying drawings, wherein.

DETAILED DESCRIPTION

Figure 1A:
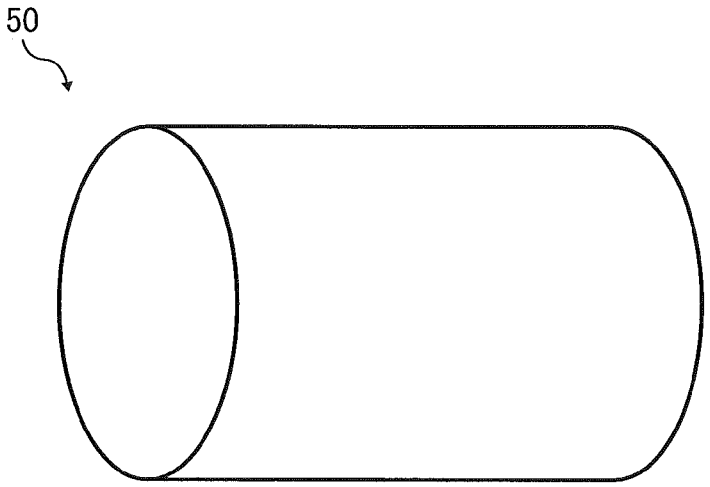
FIGS. 1A and 1B are diagrams illustrating types of structures to which a speaker according to an embodiment of this disclosure is attachable.

In describing the embodiments illustrated in the drawings, specific terminology is adopted for the purpose of clarity. However, this disclosure is not intended to be limited to the specific terminology so used, and it is to be understood that substitutions for each specific element can include any technical equivalents that have the same function, operate in a similar manner, and achieve a similar result.

Referring now to the drawings, wherein like reference numerals designate identical or corresponding parts throughout the several views to omit redundant description thereof, and structures are illustrated on different scales where necessary for the purpose of clarity, an energy converter according to an embodiment of this disclosure will be described with reference to embodiments of a speaker. This disclosure, however, is not limited to the following embodiments, and is also applicable to other energy converters, such as microphones and fans.

Figure 1B:
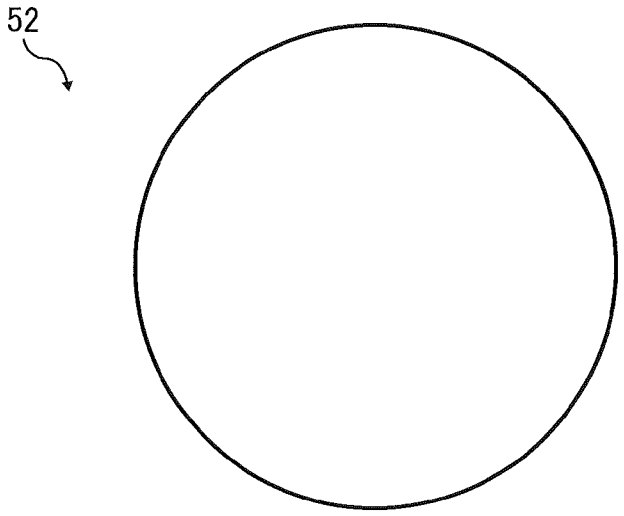

A speaker according to an embodiment of this disclosure is additionally attachable to a curved surface of a desired structure. FIGS. 1A and 1B illustrate types of areas to which the speaker according to the present embodiment is attachable, i.e., a cylindrical area 50 (hereinafter referred to as the cylinder 50) illustrated in FIG. 1A and a spherical area 52 (hereinafter referred to as the sphere 52) illustrated in FIG. 1B.

Description will now be given of a procedure to additionally attach the speaker to the cylinder 50.

Figure 2:
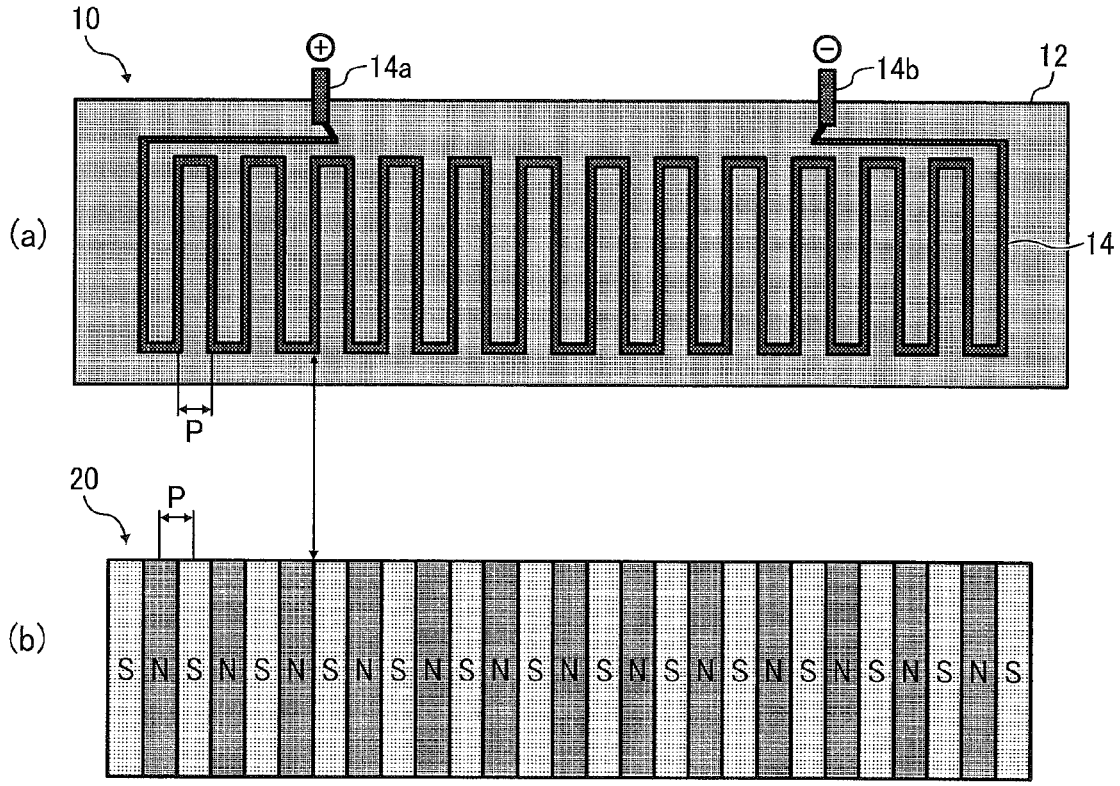
FIG. 2 is a diagram illustrating a diaphragm and a permanent magnet according to the embodiment.

In the present embodiment, a diaphragm 10 and a permanent magnet 20 illustrated in FIG. 2 are first prepared.

The diaphragm 10 may be formed of a flexible resin substrate 12 having a thickness of approximately 10 μm to approximately 30 μm. Preferably, the resin substrate 12 has a bending elastic modulus of approximately 2000 MPa to approximately 3000 MPa, and may be made of polyethylene terephthalate (PET), polyimide, or polyethylene naphthalate (PEN), for example.

The resin substrate 12 has a horizontally long rectangular shape in FIG. 2. It is preferable to set the resin substrate 12 to an appropriate width shorter than the length of the cylinder 50 and an appropriate length substantially equal to the length of the outer circumference of the cylinder 50.

The resin substrate 12 has a surface formed with a coil 14 of a meandering or pulse-shaped conductor pattern, in which conductor segments extending in the width direction of the resin substrate 12 are formed at a uniform pitch P. In the present embodiment, the conductor pattern may be formed by, for example, wet-etching the resin substrate 12 foiled with copper or screen-printing on the resin substrate 12 with a copper paste. The coil 14 has a positive terminal 14*a* and a negative terminal 14*b* to be connected to a power supply.

The permanent magnet 20 has a horizontally long rectangular shape in FIG. 2. The permanent magnet 20 is set to appropriate width and length in accordance with the width and length of the conductor pattern of the coil 14. Preferably, the permanent magnet 20 is a bonded magnet (i.e., rubber magnet) sheet readily deformable to fit the curved surface of the cylinder 50.

As illustrated in FIG. 2, the permanent magnet 20 has a magnetization pattern of parallel stripes formed such that north (N)-pole bands and south (S)-pole bands extending in the width direction of the permanent magnet 20 alternate. The magnetization pattern is configured to have the pitch P of the coil 14 formed on the diaphragm 10.

The permanent magnet 20 may be a ferrite magnet, a neodymium magnet, an alnico magnet, a samarium cobalt magnet, or the like, preferably a neodymium magnet having high magnetic force.

Figure 3A:
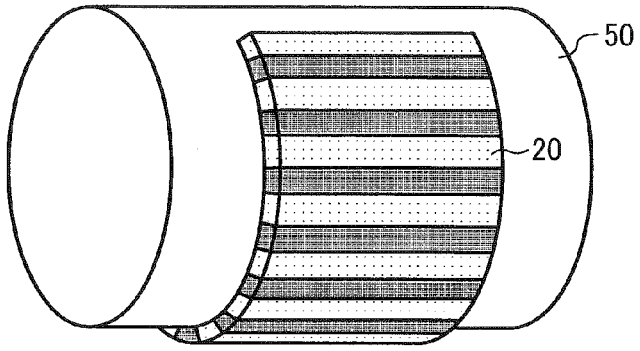
FIGS. 3A to 3C are schematic diagrams illustrating a procedure to manufacture the speaker according to the embodiment.

After the preparation of the diaphragm 10 and the permanent magnet 20 described above, the permanent magnet 20 is wrapped and fixed around the outer circumferential surface of the cylinder 50, as illustrated in FIG. 3A. In the present embodiment, the permanent magnet 20 may be embedded in the permanent magnet 20, specifically in a recess formed in the outer circumferential surface of the cylinder 50 having a depth equivalent to the thickness of the permanent magnet 20.

Figure 3B:
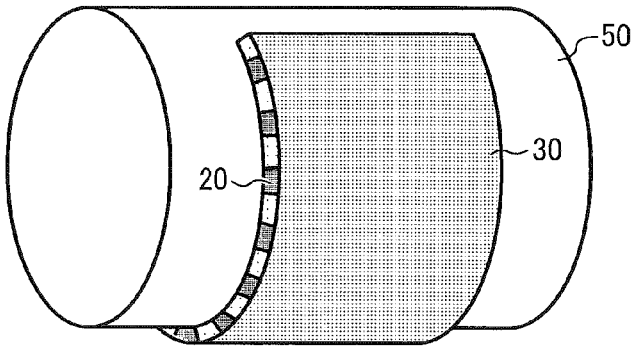

Thereafter, a buffer film 30 is disposed to cover the entirety of a surface of the permanent magnet 20, as illustrated in FIG. 3B. The buffer film 30 thus disposed prevents adhesion between the diaphragm 10 and the permanent magnet 20 and divided vibration of the diaphragm 10, and secures a range of motion allowing the diaphragm 10 to vibrate with a sufficient amplitude.

The buffer film 30 is made of a flexible non-magnetic material, and is interposed between the permanent magnet 20 and the diaphragm 10 to keep the permanent magnet 20 and the diaphragm 10 separated from each other by a constant distance. In the present embodiment, the buffer film 30 preferably has a thickness of a few micrometers to a few hundred micrometers, and may be made of cellulose fiber, such as traditional Japanese paper, cleaning paper, or cleaning wipes, for example, or an elastic material such as rubber.

Figure 3C:
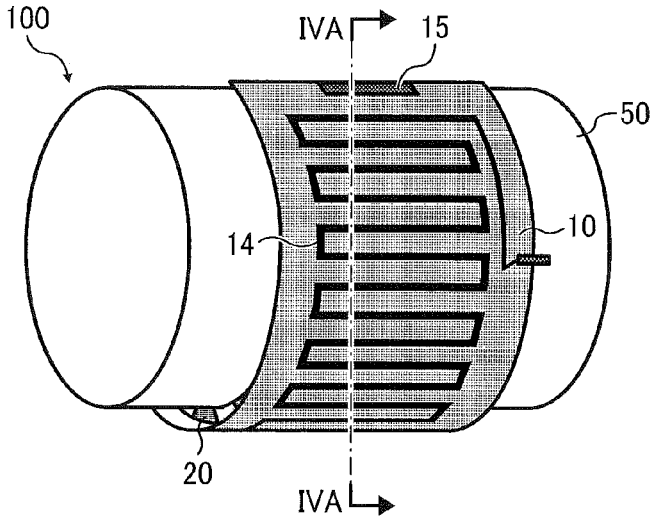

Finally, the diaphragm 10 is curled (i.e., bent) in the longitudinal direction thereof and disposed on the buffer film 30 to cover the permanent magnet 20, and opposed ends of the diaphragm 10 are fixed on the outer circumferential surface of the cylinder 50 with an appropriate fixing member 15, as illustrated in FIG. 3C.

In this process, it is desirable to position and fix the diaphragm 10 on the outer circumferential surface of the cylinder 50 such that the segments of the conductor pattern of the coil 14 on the diaphragm 10 extending in the width direction match the boundaries between the N-pole bands and the S-pole bands in the magnetization pattern of the permanent magnet 20 disposed under the diaphragm 10.

Figure 4A:
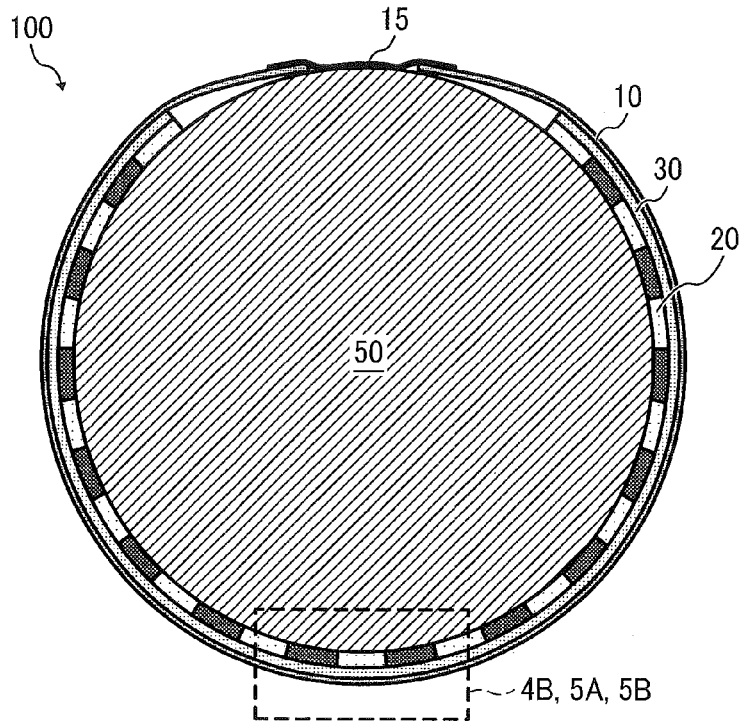
FIGS. 4A and 4B are a sectional view of the speaker according to the embodiment and an enlarged partial view thereof.
Figure 4B:
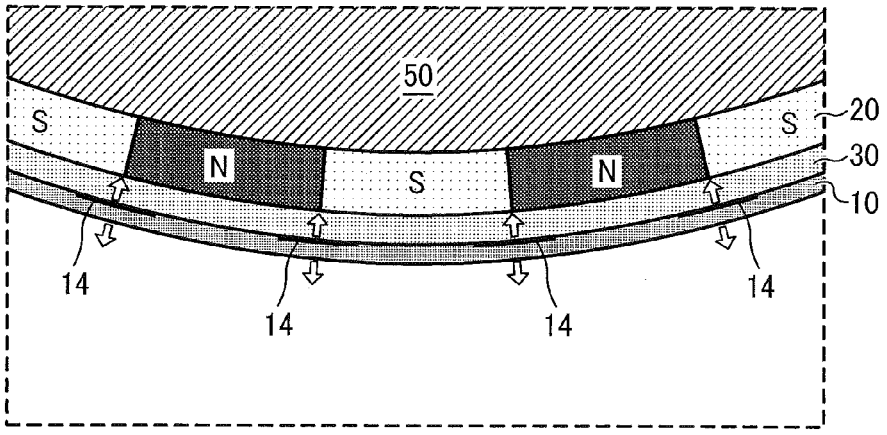

FIG. 4A is a sectional view of a speaker 100 in FIG. 3C completed through the above-described procedure, along line IVA-IVA. FIG. 4B is an enlarged view of a portion of the sectional view enclosed by a broken line.

In the enlarged view of FIG. 4B, magnetic lines of force arching from the N-pole to the S-pole on a surface of the permanent magnet 20 serve as magnetic field components. In particular, magnetic field components parallel to the surface of the permanent magnet 20 contribute substantially to electromagnetic induction of the coil 14 formed on the diaphragm 10, and are maximized near the boundaries between the N-pole bands and the S-pole bands of the magnetization pattern, i.e., the boundaries between the N-pole and the S-pole.

In the present embodiment, if a magnetic field is generated by an alternating current supplied to the coil 14, repulsive force is generated in the coil 14 by electromagnetic induction in accordance with Fleming's left-hand rule, vibrating the diaphragm 10 in the normal direction of the outer circumferential surface of the cylinder 50. If the diaphragm 10 is positioned such that the segments of the conductor pattern of the coil 14 extending in the width direction match the boundaries between the N-pole and the S-pole, as described above, the diaphragm 10 vibrates at the maximum efficiency, generating sufficient sound pressure for speaker use.

The magnetization pattern of the permanent magnet 20 and the conductor pattern forming the coil 14 are not limited to the above-described embodiments, and may be any embodiment allowing the generation of repulsive force due to electromagnetic induction when a current is supplied to the coil 14.

Figure 5A:
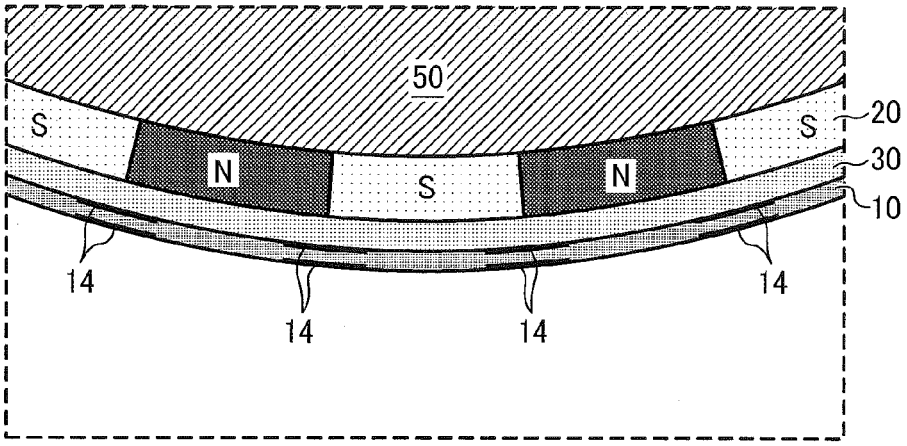
FIGS. 5A and 5B are enlarged partial sectional views of other embodiments of the speaker according to the embodiment.
Figure 5B:
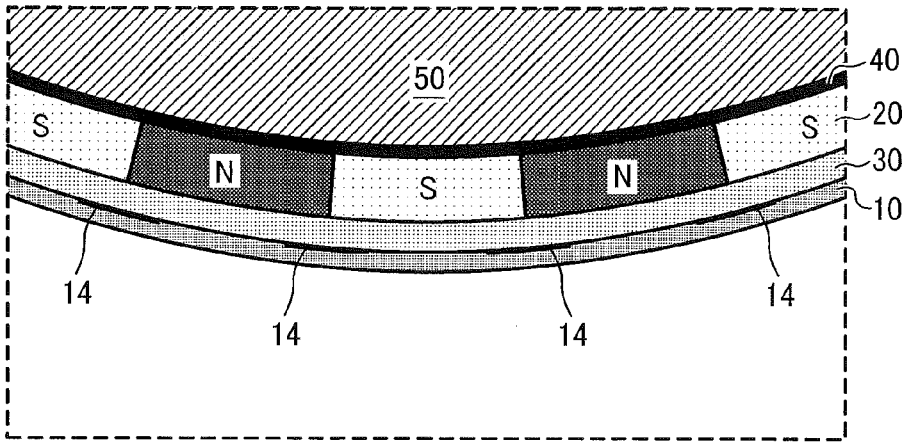

FIGS. 5A and 5B illustrate other embodiments of the speaker 100. FIG. 5A illustrates an embodiment in which the conductor pattern of the coil 14 is formed on both surfaces of the resin substrate 12 in the diaphragm 10. This embodiment increases the magnetic field to be generated by the supplied current, thereby increasing the amplitude and generating greater sound pressure.

FIG. 5B illustrates an embodiment in which a high magnetic permeability sheet 40 made of a high magnetic permeability material is disposed between the permanent magnet 20 and the cylinder 50. According to the present embodiment, the high magnetic permeability sheet 40 reduces a leakage magnetic field on the rear side of the permanent magnet 20 and increases a leakage magnetic field on the side of the diaphragm 10 (i.e., on the side of the coil 14), thereby increasing the amplitude and generating greater sound pressure.

Following the above description of the speaker 100 according to an embodiment of this disclosure, a description will be given of a speaker 200 according to another embodiment of this disclosure including a member replacing the above-described buffer film 30.

Figure 6A:
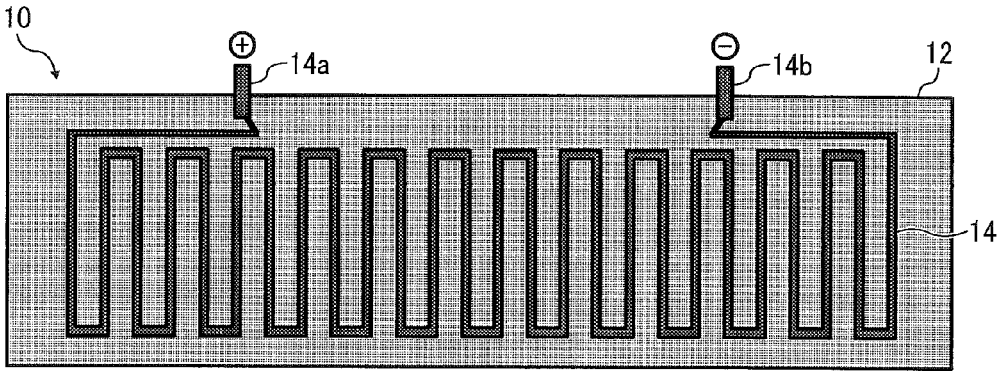
FIGS. 6A and 6B are diagrams illustrating a diaphragm according to another embodiment of this disclosure.
Figure 6B:
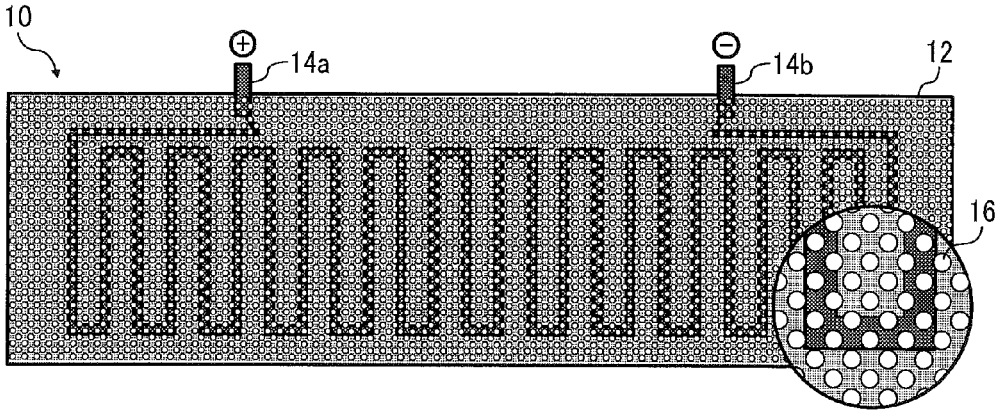

As illustrated in FIGS. 6A and 6B, in the speaker 200 according to the present embodiment, minute projections 16 made of an insulating material are formed in dots on a surface of the diaphragm 10 facing the permanent magnet 20. In the present embodiment, the projections 16 may be formed by, for example, ejecting a curable resin paste dispersed with fine silica particles onto the surface of the diaphragm 10 through nozzles or screen-printing on the surface of the diaphragm 10 with the paste.

Figure 7A:
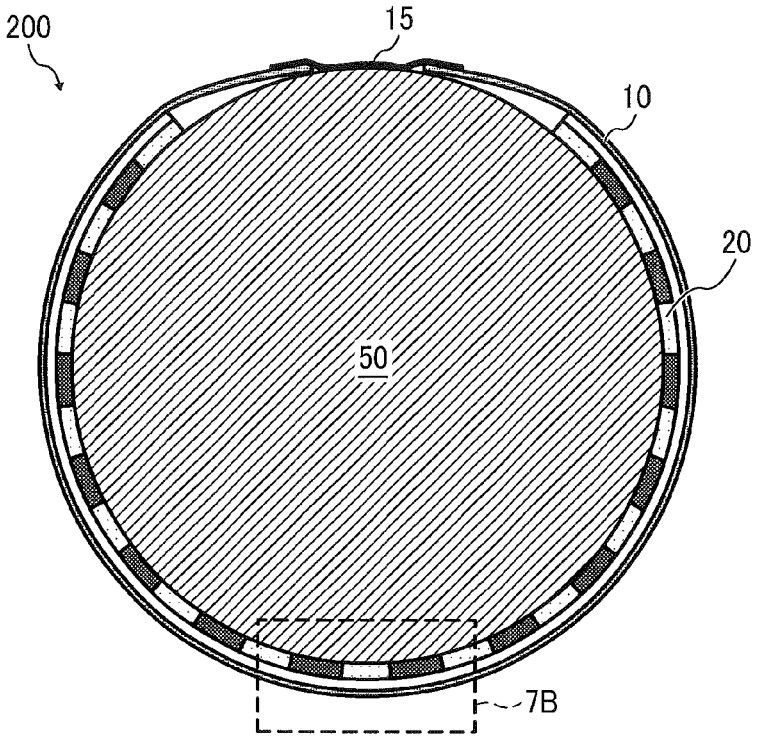
FIGS. 7A and 7B are a sectional view of a speaker according to the embodiment in FIGS. 6A and 6B and an enlarged partial view thereof.
Figure 7B:
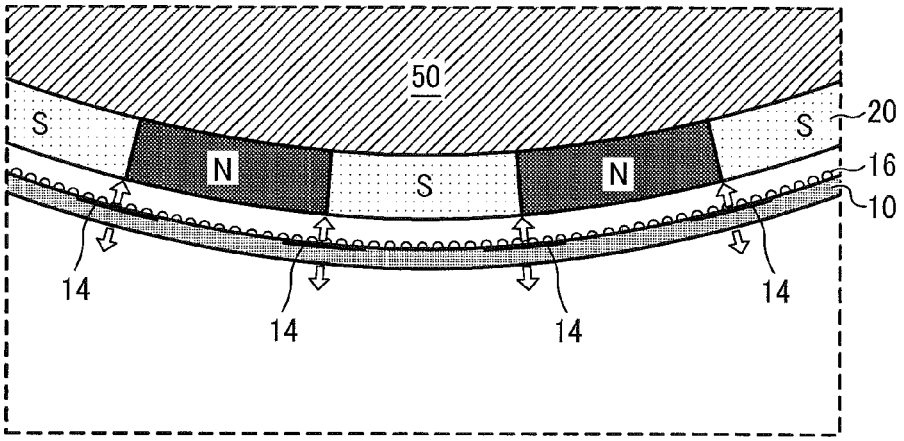

FIG. 7A is a sectional view of the speaker 200 including the diaphragm 10 having the surface formed with the dot-shaped projections 16. FIG. 7B is an enlarged view of a portion of the sectional view enclosed by a broken line.

As illustrated in the enlarged view of FIG. 7B, the speaker 200 does not have the buffer film 30 disposed between the diaphragm 10 and the permanent magnet 20. In the present embodiment, the buffer film 30 is replaced by the projections 16 formed in dots on the surface of the diaphragm 10 facing the permanent magnet 20. The projections 16 prevent adhesion between the diaphragm 10 and the permanent magnet 20 and divided vibration of the diaphragm 10, and guarantee appropriate vibration of the diaphragm 10.

Following the above description of the speaker 200 according to an embodiment of this disclosure, a description will be given of a speaker 300 according to another embodiment of this disclosure configured to secure a greater range of motion of the diaphragm 10 than in the above-described speaker 200.

Figure 8:
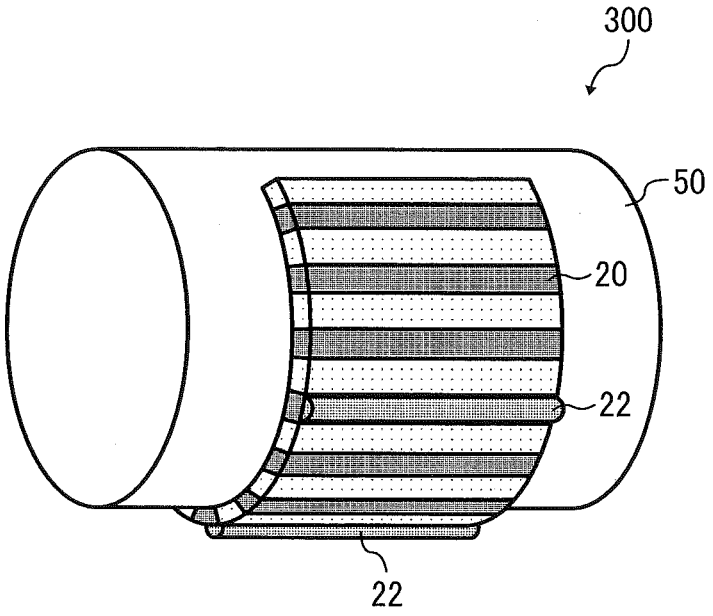
FIG. 8 is a diagram illustrating disposition of spacers according to another embodiment of this disclosure.

As illustrated in FIG. 8, the speaker 300 according to the present embodiment includes three linear spacers 22 formed on a surface of the permanent magnet 20 to extend in the width direction of the permanent magnet 20. In the present embodiment, the spacers 22 may be elastic members made of a non-magnetic material.

Figure 9A:
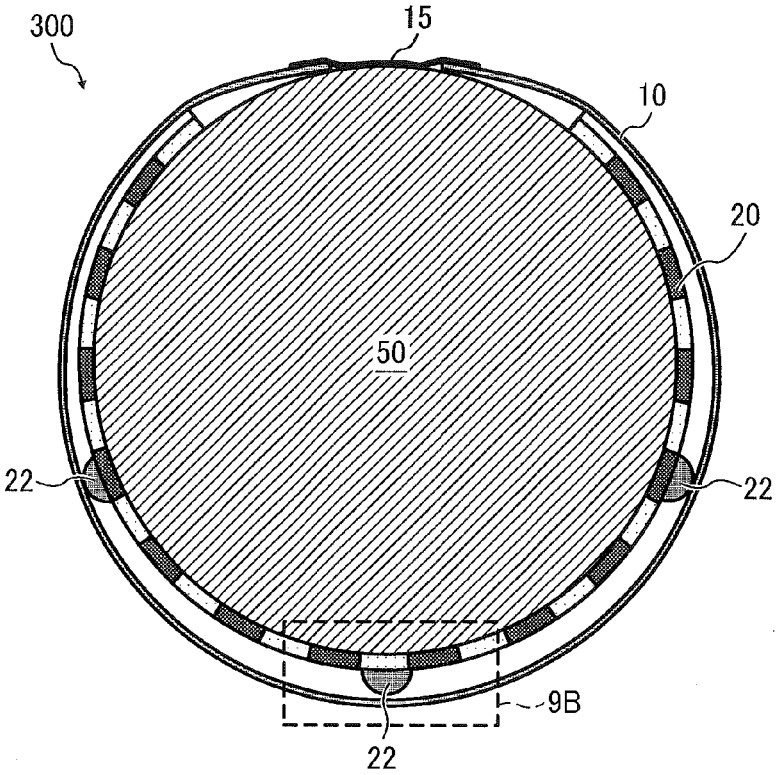
FIGS. 9A and 9B are a sectional view of a speaker according to the embodiment in FIG. 8 and an enlarged partial view thereof.
Figure 9B:
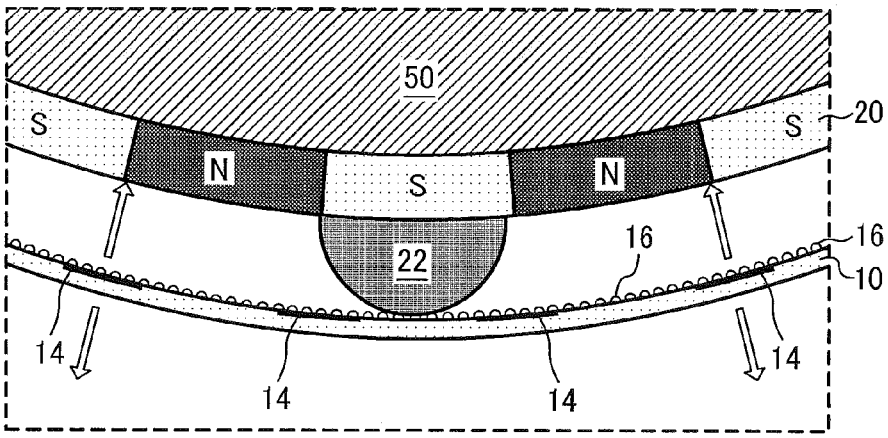

FIG. 9A is a sectional view of the speaker 300 having the spacers 22 formed on the surface of the permanent magnet 20. FIG. 9B is an enlarged view of a portion of the sectional view enclosed by a broken line.

As illustrated in the enlarged view of FIG. 9B, the speaker 300 has the spacers 22 formed between the diaphragm 10 and the permanent magnet 20 to increase the range of motion of the diaphragm 10, thereby increasing the amplitude and generating greater sound pressure.

FIG. 8 illustrates an embodiment in which the spacers 22 are formed on a surface of the permanent magnet 20 to extend along the width direction of the permanent magnet 20 (i.e., the longitudinal direction of the cylinder 50). The positions of the spacers 22, however, are not limited to those in the example illustrated in FIG. 8. As another embodiment, spacers may be formed on a surface of the permanent magnet 20 along the longitudinal direction of the permanent magnet 20 (i.e., the circumferential direction of the cylinder 50). Further, spacers may be formed as linear projections projecting from the outer circumferential surface of the cylinder 50 and extending along opposed edges of the permanent magnet 20 (i.e., along the circumferential direction of the cylinder 50).

Following the above description of the speakers attachable to the cylinder 50, a procedure to additionally attach a speaker to the sphere 52 illustrated in FIG. 1B will now be described.

Figure 10A:
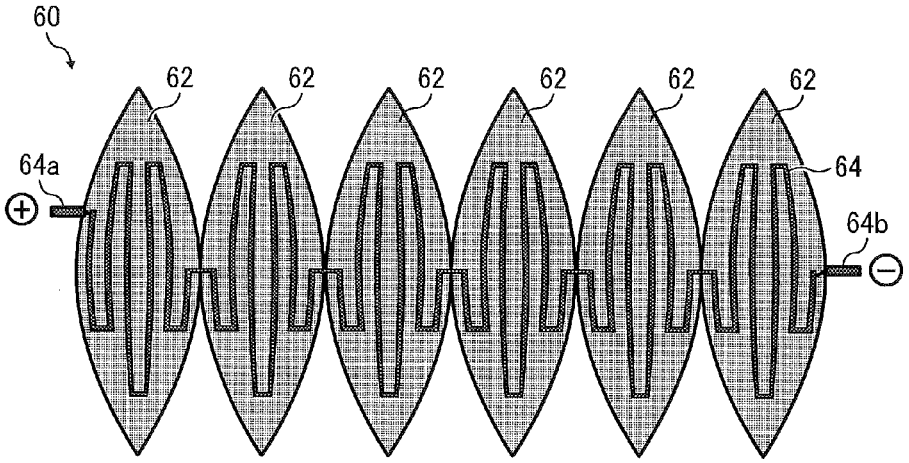
FIGS. 10A and 10B are diagrams illustrating a diaphragm according to another embodiment of this disclosure.
Figure 10B:
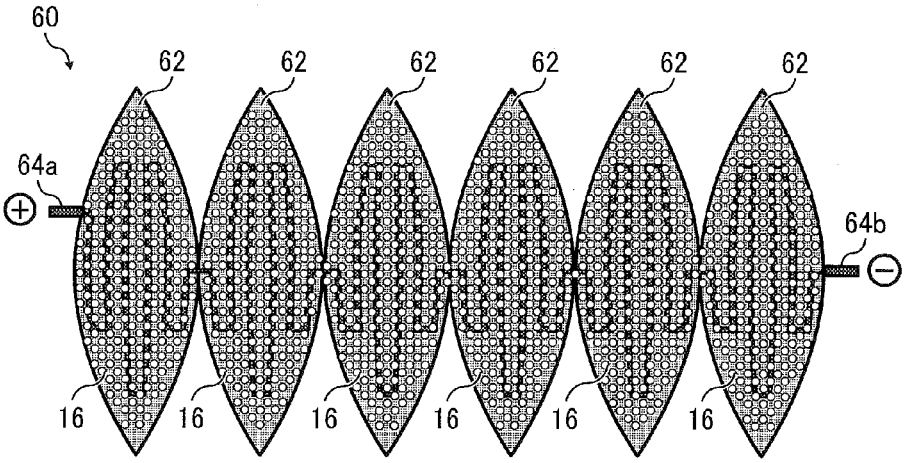

FIGS. 10A and 10B illustrate a diaphragm 60 employed in this embodiment. As illustrated in FIG. 10A, the diaphragm 60 has the shape of six spindle-shaped resin substrates 62 horizontally arranged and connected as in a view of a spread-out sphere.

Each of the spindle-shaped resin substrates 62 has a conductor pattern formed to extend along meridians of the sphere 52. The conductor patterns formed on the resin substrates 62 are connected together at respective positions at which the resin substrates 62 are connected together, thereby forming a coil 64 having a positive terminal 64*a* and a negative terminal 64*b*. The resin substrates 62 may be made of a material similar to the material forming the resin substrate 12 in the foregoing embodiments. Similarly, the coil 64 may be made of a material similar to the material forming the coil 14 in the foregoing embodiments.

In the present embodiment, the minute projections 16 made of an insulating material are formed in dots on a surface of the diaphragm 60 facing a later-described permanent magnet 70 by a method similar to the method described with reference to FIGS. 6A and 6B. FIG. 10B illustrates the diaphragm 60 having the surface formed with the dot-shaped projections 16.

Figure 11A:
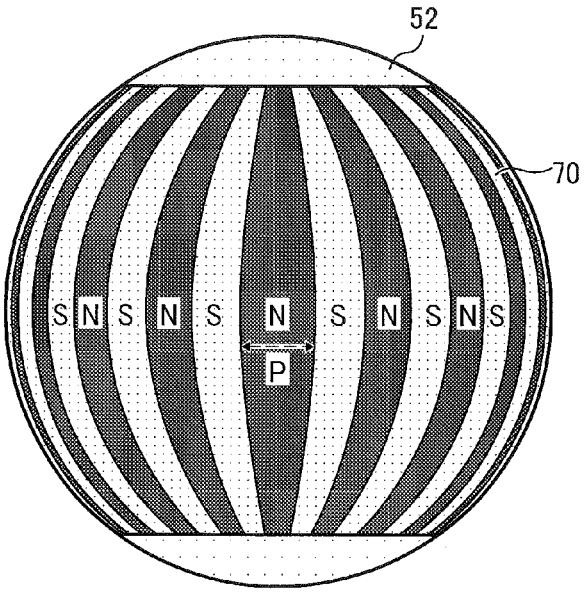
FIGS. 11A and 11B are diagrams illustrating a speaker according to the embodiment in FIGS. 10A and 10B.

In the present embodiment, the permanent magnet 70 being a bonded magnet is fixed to the sphere 52 along the curved surface of the sphere 52 to surround the outer circumference of the sphere 52, as illustrated in FIG. 11A.

As illustrated in FIG. 11A, the permanent magnet 70 has a magnetization pattern of parallel stripes formed such that N-pole bands and S-pole bands extending along the longitudinal direction of the sphere 52 alternate. The magnetization pattern is configured to have the pitch P of the coil 64 formed on the diaphragm 60.

Figure 11B:
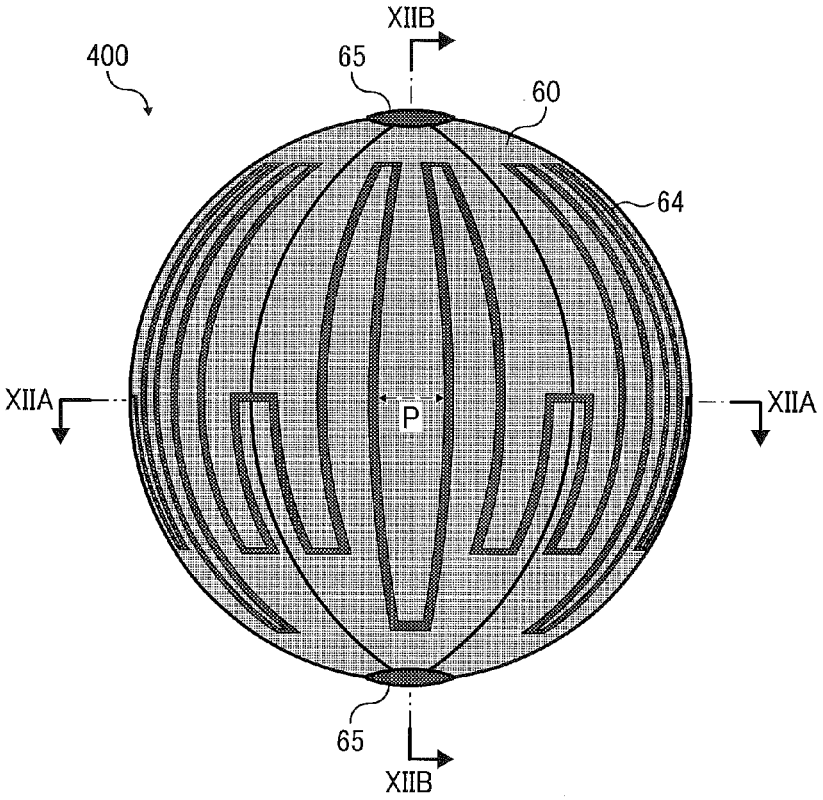

Then, as illustrated in FIG. 11B, the diaphragm 60 is wrapped around the sphere 52 to cover the sphere 52 such that the surface of the diaphragm 60 formed with the projections 16 faces inside. Thereafter, the vertices of the six resin substrates 62 are joined and fixed to the surface of the sphere 52 with appropriate fixing members 65.

In this process, it is desirable to position and fix the diaphragm 60 on the surface of the sphere 52 such that the segments of the conductor pattern of the coil 64 on the diaphragm 60 extending in the longitudinal direction of the sphere 52 match the boundaries between the N-pole and the S-pole in the magnetization pattern of the permanent magnet 70 located under the diaphragm 60.

Figure 12A:
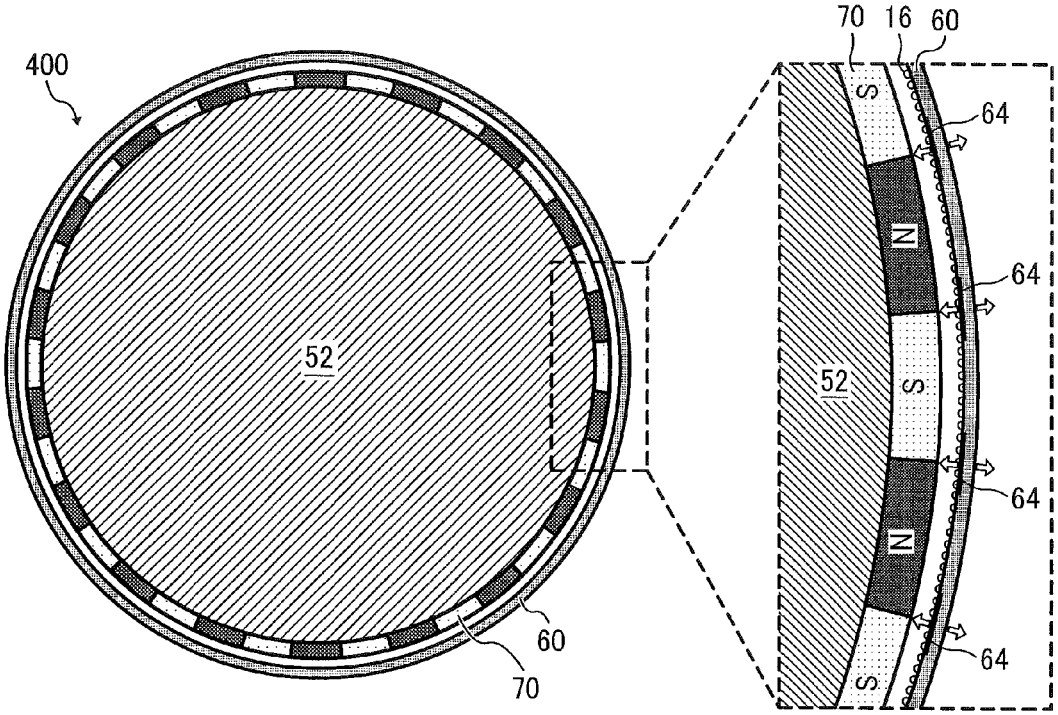
FIGS. 12A and 12B are sectional views of the speaker according to the embodiment in FIGS. 11A and 11B.
Figure 12B:
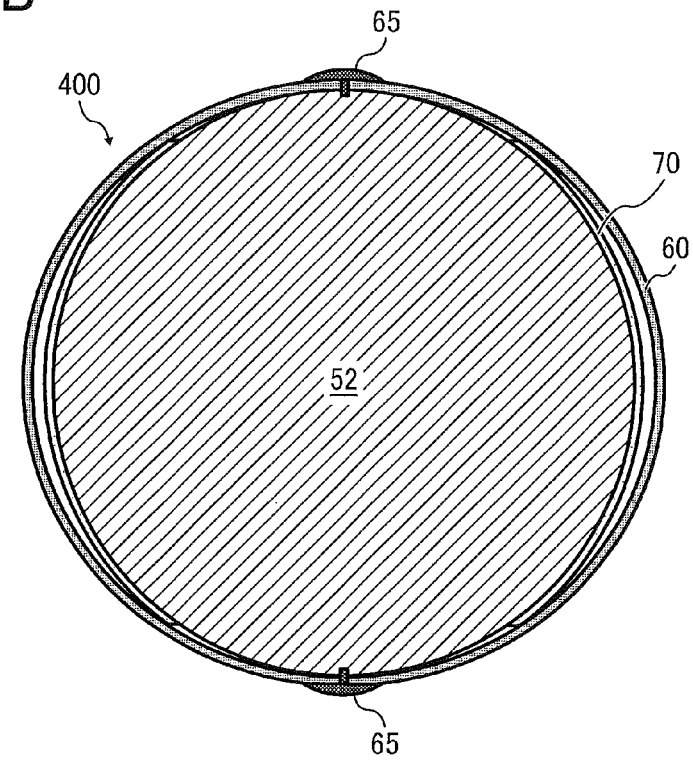

FIG. 12A is a sectional view of a speaker 400 in FIG. 11B completed through the above-described procedure, along line XIIA-XIIA, and an enlarged view of a portion of the sectional view. FIG. 12B is a sectional view of the speaker 400 along line XIIB-XIIB.

In the present embodiment, if a magnetic field is generated by an alternating current supplied to the coil 64, repulsive force is generated in the coil 64 owing to electromagnetic induction in accordance with Fleming's left-hand rule, vibrating the diaphragm 60 in the normal direction of the surface of the sphere 52. If the diaphragm 60 is positioned such that the conductor pattern of the coil 64 matches the boundaries between the N-pole and the S-pole, as described above, the diaphragm 60 vibrates at the maximum efficiency, generating sufficient sound pressure for speaker use.

The magnetization pattern of the permanent magnet 70 and the conductor pattern forming the coil 64 are not limited to the above-described embodiments, and may be any embodiment allowing the generation of repulsive force due to electromagnetic induction when a current is supplied to the coil 64.

As described above, according to an embodiment of this disclosure, it is possible to additionally attach a speaker to a curved surface of a desired structure. As an application of this disclosure, it is conceivable to apply a speaker according to an embodiment of this disclosure to a curved surface of an existing structure.

A socket of a linear fluorescent lamp is an example of the existing structure. When a typical conical speaker is additionally attached to such a socket, the speaker (or the diaphragm included therein) needs to be small in size owing to the limitation of space. In that case, sufficient spread of sound is not expected.

In this regard, a speaker according to an embodiment of this disclosure is attachable to a cylindrical curved surface of the socket of the linear fluorescent lamp. In this case, acoustic waves generated by the diaphragm having an arc curved surface propagate in a wide range in the normal direction of the curved surface of the diaphragm.

The above-described embodiment using the socket of the linear fluorescent lamp is a mere example. Thus, any structure having a curved surface is usable as the area to which a speaker according to an embodiment of this disclosure is attached.

Further, although the speaker is additionally attached to a curved surface area of an existing structure in the above-described embodiment, a special structure for the speaker may, of course, be prepared.

Further, although the speaker is additionally attached to a curved surface of a structure in the foregoing description, a speaker according to another embodiment of this disclosure is additionally attached to pyramidal surfaces of a structure having a pyramidal shape (including a truncated pyramidal shape) as the attachment area, realizing non-directivity.

Further, although the speaker is constantly attached to a structure previously assumed as the attachment area in the foregoing description, a speaker according to another embodiment of this disclosure is freely attachable to and detachable from a desired structure, not limited to previously assumed structures. The speaker according to the embodiment attachable to and detachable from a desired structure will now be described.

With reference to FIGS. 13A to 13E, a process of manufacturing a speaker 500 according to this embodiment will be described.

Figure 13A:
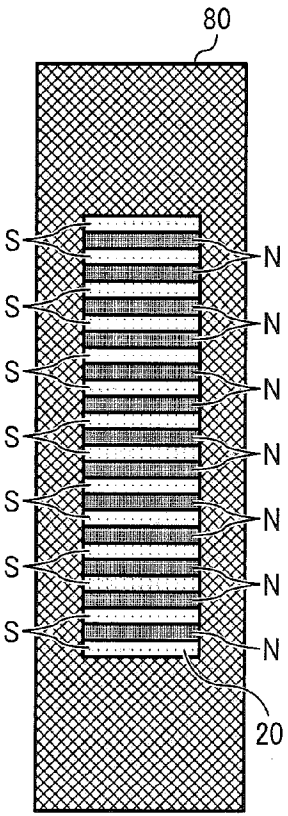
FIGS. 13A to 13E are diagrams illustrating a process of manufacturing a speaker according to another embodiment of this disclosure.

In the present embodiment, a band-shaped plastic substrate 80 is first prepared, and the permanent magnet 20 is disposed at the center of the plastic substrate 80, as illustrated in FIG. 13A. The plastic substrate 80 is made of a plastic material. Preferably, the plastic substrate 80 is heat-conductive in consideration of the possibility of being attached to a heat source such as a fluorescent lamp. Further, preferably, the plastic substrate 80 is flame-retardant from a safety perspective, and has electromagnetic shielding performance sufficient to attain a high signal-to-noise (S/N) ratio.

Figure 13B:
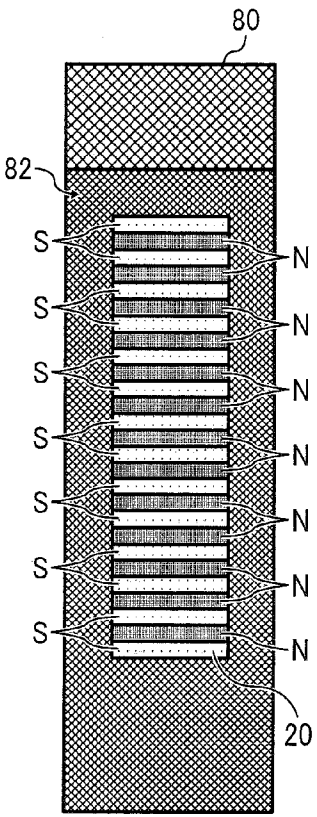

Then, as illustrated in FIG. 13B, an adhesive agent 82 is applied to an area in the plastic substrate 80 not having the permanent magnet 20 and the side surfaces of the permanent magnet 20. In this process, the adhesive agent 82 is not applied to the upper surface of the permanent magnet 20. The adhesive agent 82 is neither applied to one end portion of the plastic substrate 80, to which a later-described hook-and-loop fastener 85 is to be attached later. In the present embodiment, the adhesive agent 82 may be replaced by a double-sided adhesive tape.

Figure 13C:
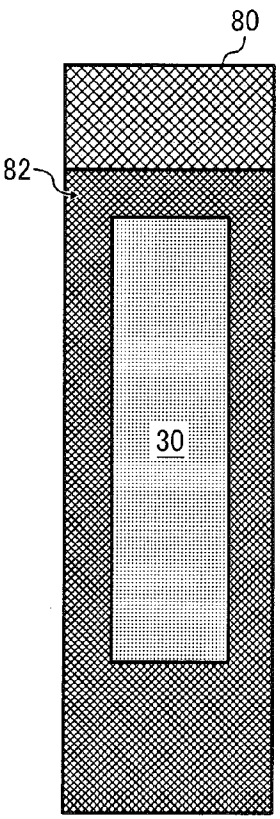

As illustrated in FIG. 13C, the buffer film 30 is then disposed on the permanent magnet 20. As described above with reference to FIG. 3B, the buffer film 30 made of a flexible non-magnetic material is interposed between the permanent magnet 20 and the diaphragm 10 to keep the permanent magnet 20 and the diaphragm 10 separated from each other by a constant distance. The buffer film 30 may be made of cellulose fiber, such as traditional Japanese paper, cleaning paper, or cleaning wipes, or an elastic material such as rubber.

Figure 13D:
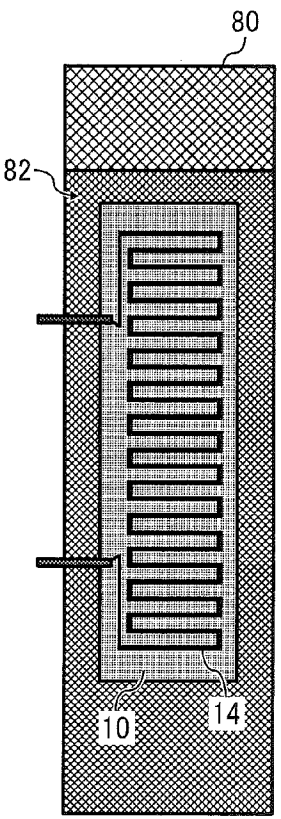

Then, as illustrated in FIG. 13D, the diaphragm 10 is disposed on the buffer film 30. In this process, it is desirable to position and dispose the diaphragm 10 such that the segments of the conductor pattern of the coil 14 on the diaphragm 10 extending in the width direction of the coil 14 match the boundaries between the N-pole and the S-pole in the magnetization pattern of the permanent magnet 20 located under the diaphragm 10.

Figure 14A:
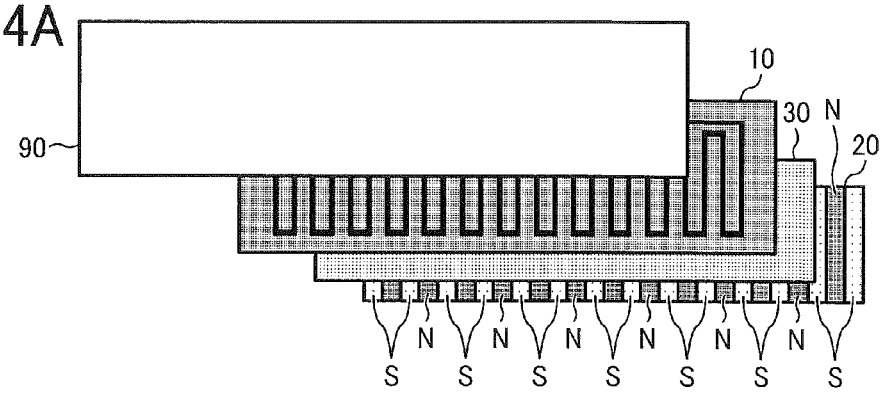
FIGS. 14A to 14D are conceptual diagrams illustrating a method of positioning a diaphragm according to the embodiment in FIGS. 13A to 13E.

FIG. 14A to 14D are conceptual diagrams illustrating a method of positioning the diaphragm 10. According to this method, in the process of disposing the diaphragm 10 on a laminate of the permanent magnet 20 and the buffer film 30, a magnetic sheet 90 is placed on the diaphragm 10 to partially expose the conductor pattern of the coil 14, as illustrated in FIG. 14A. The magnetic sheet 90 is a film sheet having a magnetic fluid uniformly distributed and encapsulated therein, serving as a functional sheet capable of visualizing the magnetization pattern of a magnet.

Figure 14B:
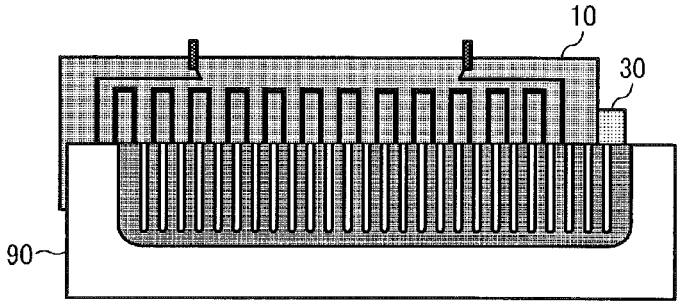
Figure 14C:
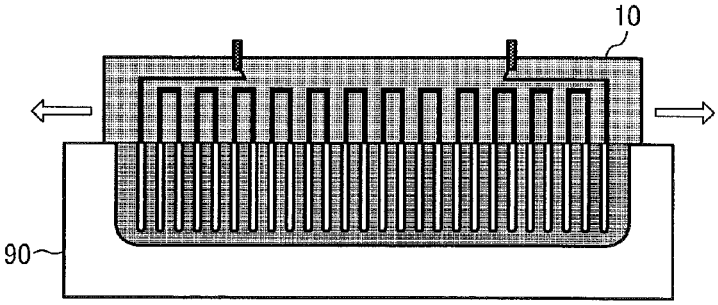
Figure 14D:
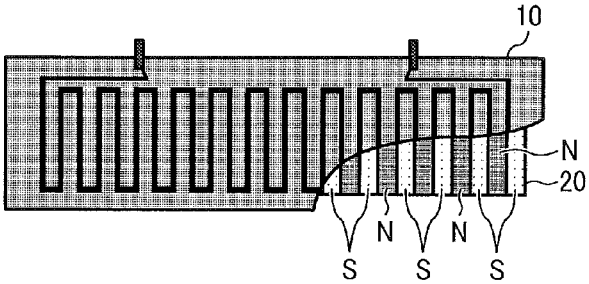

In the magnetic sheet 90 placed on the diaphragm 10, the magnetization pattern of the permanent magnet 20 disposed under the buffer film 30 is visualized as a shading pattern of the magnetic fluid, as illustrated in FIG. 14B. With this mechanism, the diaphragm 10 is adjusted in position to be disposed at a position at which the shading pattern appearing on the magnetic sheet 90 matches the conductor pattern of the coil 14, as illustrated in FIG. 14C. Consequently, the diaphragm 10 is disposed such that the positions of the segments of the conductor pattern of the coil 14 extending in the width direction match the boundaries between the N-pole and the S-pole in the magnetization pattern of the permanent magnet 20 disposed under the coil 14, as illustrated in a cut-out portion of the diaphragm 10 in FIG. 14D. The above-described positioning method is, of course, similarly applicable to other embodiments of this disclosure.

Figure 13E:
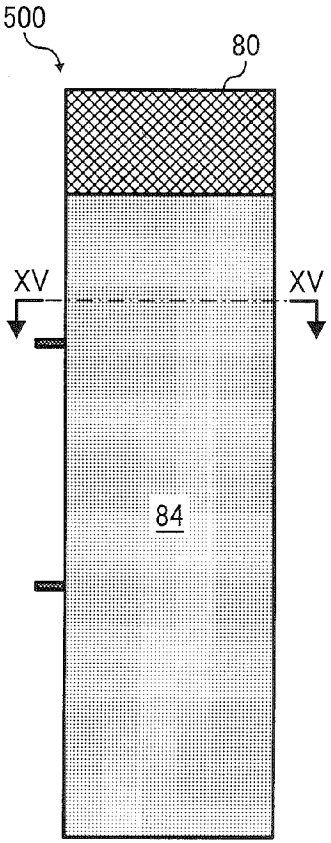

Finally, a protective sheet 84 having the same width as the width of the plastic substrate 80 is disposed on the diaphragm 10, and outer edge portions of the protective sheet 84 are bonded to the plastic substrate 80 with the adhesive agent 82, as illustrated in FIG. 13E. Thereby, the band-shaped speaker 500 is obtained. Preferably, the protective sheet 84 is made of a material that transmits sound, such as a porous material, and is water-repellant and flame-retardant.

Figure 15:
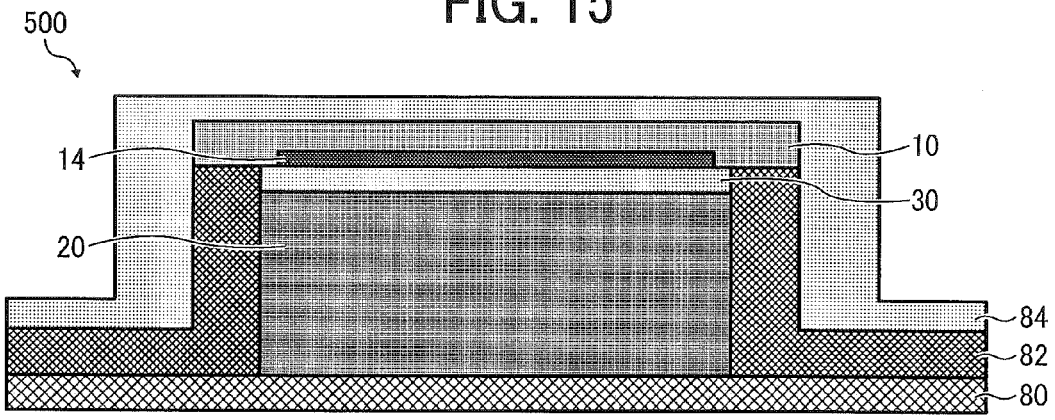
FIG. 15 is a sectional view of the speaker according to the embodiment in FIG. 13E.

FIG. 15 is a sectional view along line XV-XV in FIG. 13E. In FIG. 15, the scale is increased in the thickness direction for the sake of clarity. In the speaker 500, a laminate structure including the permanent magnet 20, the buffer film 30, and the diaphragm 10 disposed on the plastic substrate 80 is fixed by the protective sheet 84 covering and sealing the laminate structure, as illustrated in FIG. 15.

Figure 16A:
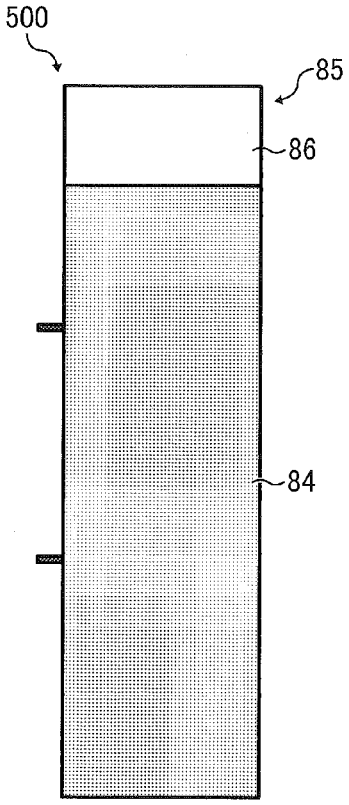
FIGS. 16A and 16B are diagrams illustrating a front surface and a rear surface of the speaker according to the embodiment in FIG. 15, respectively.
Figure 16B:
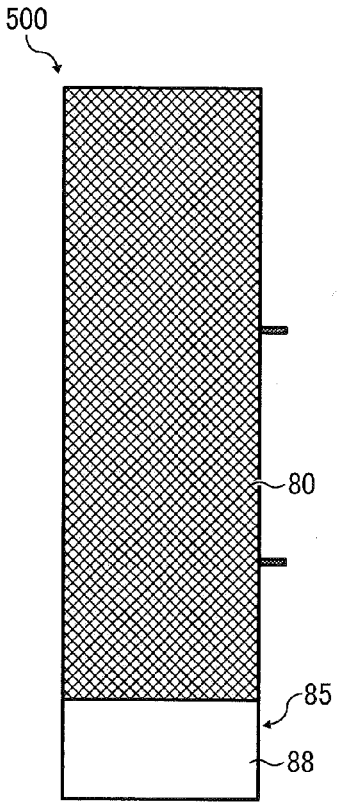

Further, in the present embodiment, opposed end portions of the band-shaped speaker 500 are provided with the hook-and-loop fastener 85, as illustrated in FIGS. 16A and 16B, allowing simple attachment and detachment of the speaker 500. In the example illustrated in FIGS. 16A and 16B, a male surface 86 of the hook-and-loop fastener 85 is provided to an end portion of the front surface of the speaker 500 in FIG. 13E not applied with the adhesive agent 82, and a female surface 88 of the hook-and-loop fastener 85 is provided to an end portion of the rear surface of the speaker 500 on the opposite side of the end portion of the speaker 500 having the male surface 86. In the example illustrated in FIGS. 16A and 16B, it is possible to easily attach the speaker 500 to a desired structure (e.g., a fluorescent lamp) by wrapping the speaker 500 around the structure with the protective sheet 84 facing out and sticking the male surface 86 and the female surface 88 of the hook-and-loop fastener 85 together. Similarly, it is possible to easily detach the speaker 500 from the structure by separating the male surface 86 and the female surface 88 of the hook-and-loop fastener 85 from each other.

This disclosure has been described above with reference to several embodiments, but is not limited to the above-described embodiments. For example, it is preferable to perform surface treatment on the above-described magnets to prevent the magnets from rusting, and cover the outermost surfaces of the speakers with a protective sheet such as a porous fluorine film to protect the speakers. Although an energy converter according to an embodiment of this disclosure has been described above with reference to embodiments of a speaker, this disclosure is, of course, also applicable to a microphone. Further, the elements disclosed in the foregoing embodiments may be combined in other embodiments not explicitly disclosed herein, and any other embodiments conceivable by a person skilled in the art and having the functions and effects of this disclosure are included in the scope of this disclosure.

An energy converter according to an embodiment of this disclosure will now be described more specifically with reference to embodiment examples. This disclosure, however, is not limited to the following embodiment examples.

The speakers according to the above-described embodiments were produced, and an experiment was conducted to evaluate the directivity of the speakers.

In the production of the speakers, five speakers attached to a curved surface of a polycarbonate cylinder as the attachment area were produced as embodiment examples E1 to E5, and a speaker attached to a curved surface of a polycarbonate sphere as the attachment area were produced as embodiment example E6.

In embodiment example E1, a 20 μm-thick polyimide resin film having one surface formed with a coil of a copper pattern having a thickness of 9 μm and a pitch of 3 mm was used as the diaphragm. In embodiment examples E2 to E6, a 20 μm-thick polyimide resin film with the same coil formed in both surfaces as described above was used as the diaphragm.

In embodiment examples E1, E2, E3, E5, and E6, a bonded neodymium magnet having a leakage magnetic field of ±100 gauss, a thickness of 1 mm, and a pitch of 3 mm was externally attached to the attachment area. In embodiment example E4, the same magnet as described above was embedded in the attachment area such that the magnet is flush with the surrounding area.

In embodiment examples E3, E4, and E5, linear rubber members each having a width of 2 mm, a length of 24 mm, and a thickness of 1 mm were disposed as spacers, as illustrated in FIG. 8.

In embodiment example E5, a high magnetic permeability magnetic sheet BUSTERAID FK3 manufactured by NEC-TOKIN Corporation was disposed between the bonded neodymium magnet and the attachment area.

In embodiment example E6, the 20 μm-thick polyimide resin film was cut in the shape of spindles, and a surface of the polyimide resin film to face the magnet was formed with dot-shaped projections. In the present embodiment example, the dot-shaped projections were formed by applying and hardening a paste of tetraethyl orthosilicate dispersed with silica composite particles having an average particle diameter of approximately 5 μm and added with an ethyl cellulose binder by the use of a jet dispenser Aero Jet manufactured by Musashi Engineering, Inc. and having a needle diameter of 0.3 mm.

In comparative example C1, a speaker was produced by externally attaching a bonded neodymium magnet having a leakage magnetic field of ±100 gauss and a thickness of 1 mm to a flat surface of a flat polycarbonate plate as the attachment area, and disposing a diaphragm on the magnet. The diaphragm employed here is a 20 μm-thick polyimide resin film having one surface formed with a coil of a copper pattern having a thickness of 9 μm.

TABLE 1 given below summarizes conditions for producing the speakers in the present experiment.

TABLE 1

| | shape of base | magnet | spacers | dot-shaped projections | coil | magnetic sheet |
|---|---|---|---|---|---|---|
| E1 | cylinder | externally attached | absent | absent | one surface | absent |
| E2 | cylinder | externally attached | absent | absent | both surfaces | absent |
| E3 | cylinder | externally attached | present | absent | both surfaces | absent |
| E4 | cylinder | embedded | present | absent | both surfaces | absent |
| E5 | cylinder | externally attached | present | absent | both surfaces | present |
| E6 | sphere | externally attached | absent | present | both surfaces | absent |
| C1 | flat plate | externally attached | absent | absent | one surface | absent |

Figure 17A:
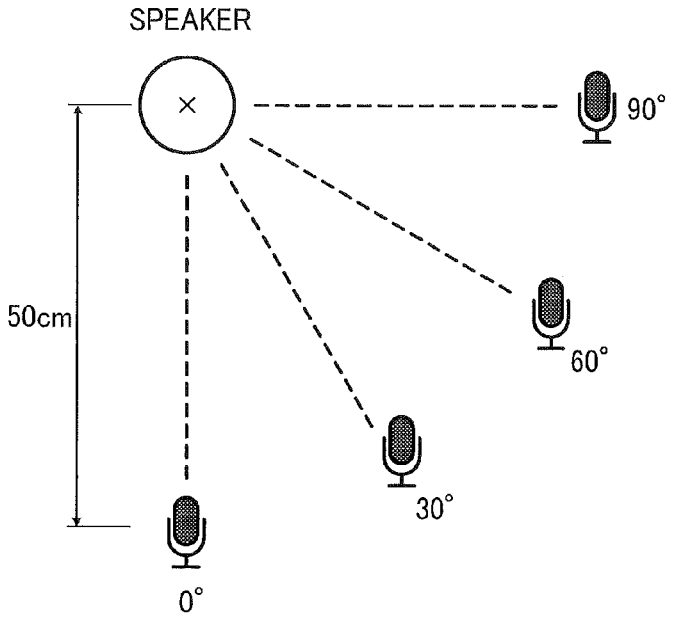
FIGS. 17A and 17B are diagrams illustrating conditions of an experiment for evaluating directivity characteristics.
Figure 17B:
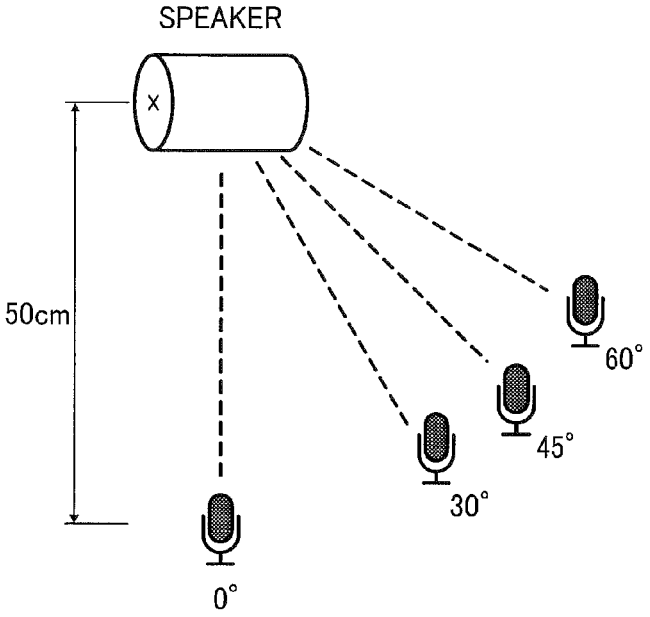

In the evaluation of directivity, the sound output from each of the speakers produced in the above-described procedures was measured with a non-directional microphone Type 4152 manufactured by Aco Co., Ltd. to evaluate the directivity of the speaker. In the present experiment, the distance between the speaker and the microphone was set to 50 cm. The sound output from the speaker was measured at four measurement positions illustrated in FIG. 17A indicated as relative angles 0°, 30°, 60°, and 90° in the circumferential direction of the speaker to a reference line passing through the center of the speaker and four measurement positions illustrated in FIG. 17B indicated as relative angles 0°, 30°, 45°, and 60° in the longitudinal direction of the speaker to the reference line passing through the center of the speaker.

In the present measurement, two types of sounds, i.e., sound at 10 KHz and sound at 20 KHz, generated by free software WaveGene Ver 1.4 for outputting sound at a single frequency were output from the speaker and measured with sound pressure measuring software Spectra developed by Aco Co., Ltd. TABLE 2 given below summarizes measurement results obtained at the four positions illustrated in FIG. 17A. TABLE 3 given below summarizes measurement results obtained at the four positions illustrated in FIG. 17B.

TABLE 2

| | rms sound pressure (dB) at frequency of 10 KHz measurement position (angle) | | | | rms sound pressure (dB) at frequency of 20 KHz measurement position (angle) | | | |
|---|---|---|---|---|---|---|---|---|
| | 0 | 30 | 60 | 90 | 0 | 30 | 60 | 90 |
| E1 | 81 | 81 | 81 | 66 | 60 | 62 | 62 | 59 |
| E2 | 86 | 86 | 86 | 68 | 65 | 68 | 68 | 65 |
| E3 | 87 | 87 | 87 | 69 | 70 | 70 | 70 | 67 |
| E4 | 88 | 88 | 88 | 70 | 71 | 71 | 71 | 68 |
| E5 | 89 | 89 | 89 | 69 | 72 | 72 | 72 | 69 |
| E6 | 88 | 88 | 88 | 88 | 71 | 71 | 71 | 71 |
| C1 | 81 | 78 | 67 | 35 | 60 | 51 | 47 | 33 |

TABLE 3

| | rms sound pressure (dB) at frequency of 10 KHz measurement position (angle) | | | | rms sound pressure (dB) at frequency of 20 KHz measurement position (angle) | | | |
|---|---|---|---|---|---|---|---|---|
| | 0 | 30 | 45 | 60 | 0 | 30 | 45 | 60 |
| E1 | 81 | 81 | 78 | 71 | 60 | 62 | 54 | 51 |
| E2 | 86 | 86 | 83 | 75 | 65 | 67 | 60 | 55 |
| E3 | 87 | 86 | 83 | 77 | 70 | 70 | 62 | 57 |
| E4 | 88 | 88 | 84 | 78 | 71 | 71 | 63 | 58 |
| E5 | 89 | 88 | 85 | 78 | 72 | 71 | 63 | 58 |
| E6 | 88 | 88 | 85 | 77 | 71 | 71 | 63 | 57 |
| C1 | 81 | 78 | 62 | 34 | 60 | 58 | 41 | 32 |

It has been found from the measurement results in TABLE 2 and TABLE 3 given above that the measured sound pressure (dB) is reduced with the increase of the relative angle to the reference line perpendicular to the flat planar diaphragm in comparative example C1, indicating directivity of the speaker, whereas there is no substantial change in the measured sound pressure (dB) with the increase of the relative angle in embodiment examples E1 to E6.

Further, speakers each including a bobbin-shaped structure were produced, and an experiment was conducted to evaluate the directivity of the speakers.

Figure 18A:
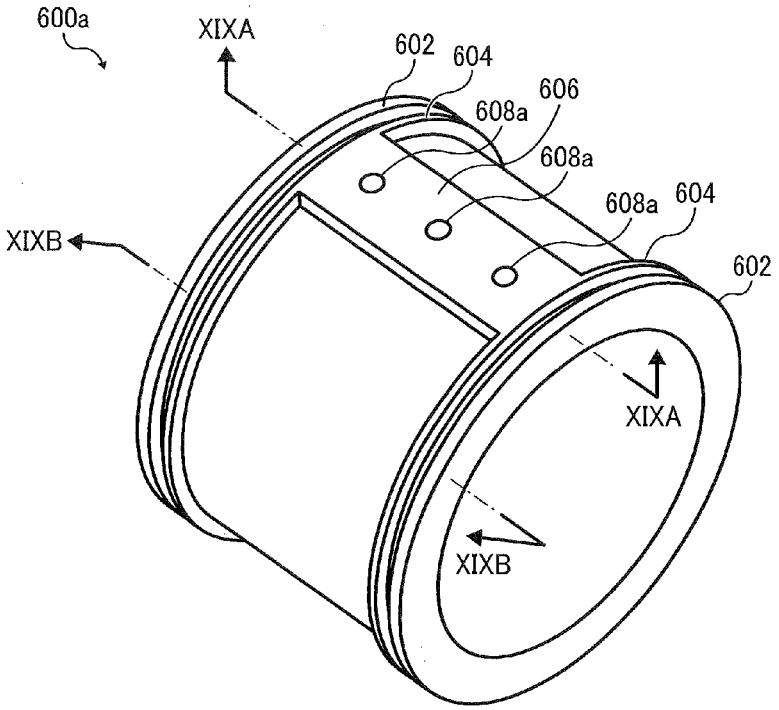
FIGS. 18A to 18C are diagrams illustrating structures forming speakers according to embodiment examples of this disclosure.
Figure 18B:
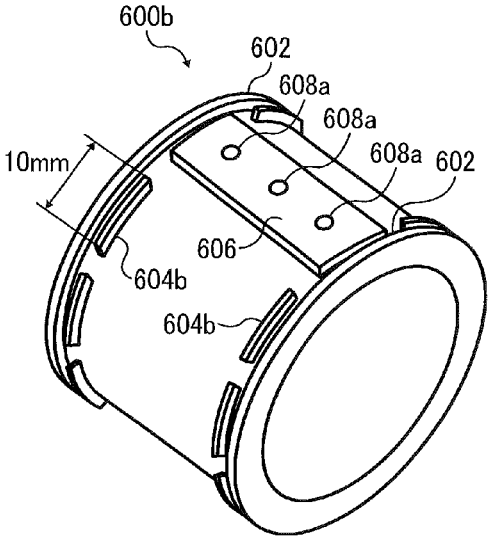
Figure 18C:
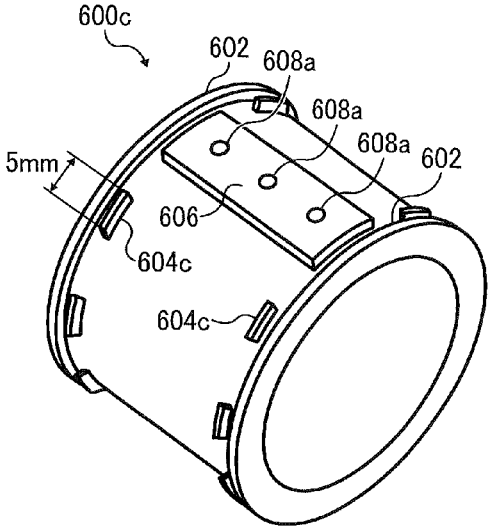

In the production of the speakers, bobbin-shaped structures 600*a* to 600*c* illustrated in FIGS. 18A to 18*c*, respectively, were produced of polycarbonate. In the structure 600*a*, paired fringes 602 are formed along opposed edges of a cylindrical body of the structure 600*a*, and paired linear projections 604 are formed on the outer circumferential surface of the cylindrical body of the structure 600*a* to extend around the entire circumference of the cylindrical body at respective positions inside the fringes 602. Further, a band-shaped projection 606 having screw holes 608*a* is formed on the outer circumferential surface of the cylindrical body of the structure 600*a* to be flush with the paired linear projections 604. In the structure 600*b*, linear projections 604*b* each having a length of 10 mm are formed at regular intervals. In the structure 600*c*, linear projections 604*c* each having a length of 5 mm are formed at regular intervals.

In embodiment example E7, a speaker was produced by externally fixing a bonded neodymium magnet having a leakage magnetic field of ±100 gauss, a thickness of 1 mm, and a pitch of 3 mm to an area of the above-produced structure 600*a* between the paired linear projections 604, and disposing a diaphragm to cover the magnet. The diaphragm employed here is a 20 μm-thick polyimide resin film with a coil of a copper pattern having a thickness of 9 μm and a pitch of 3 mm formed in both surfaces.

Figure 19B:
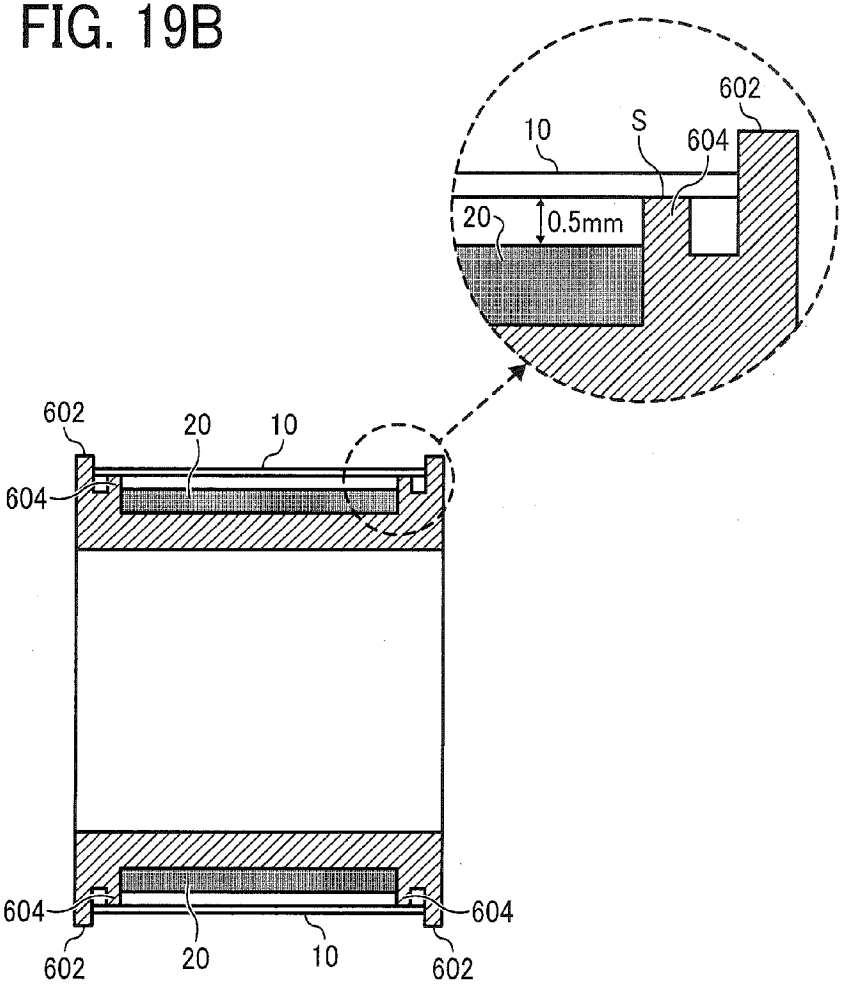
FIGS. 19A and 19B are sectional views of a speaker according to an embodiment example of this disclosure.
Figure 19A:
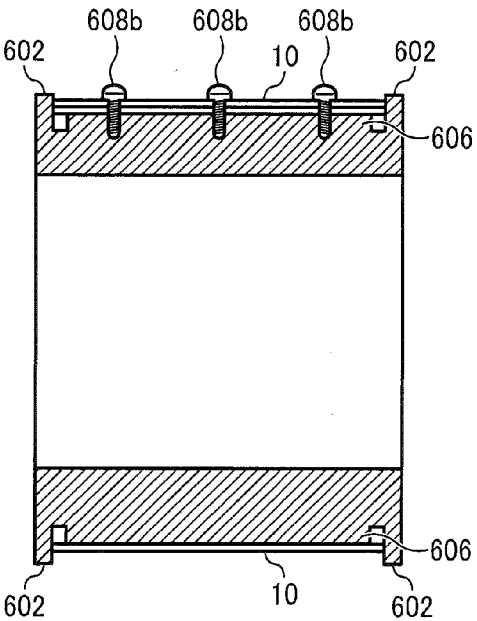

FIG. 19A is a sectional view of the speaker produced in the above-described procedure, along line XIXA-XIXA in FIG. 18A. FIG. 19B is a sectional view of the thus-produced speaker along line XIXB-XIXB in FIG. 18A.

As illustrated in FIG. 19A, in the present embodiment example, the opposed ends of the diaphragm 10 are superimposed upon each other on the band-shaped projection 606 having the screw holes 608*a*, and fixed with screws 608*b*. Further, as illustrated in FIG. 19B, a gap of 0.5 mm is maintained between the magnet 20 and the diaphragm 10 resting on and supported by the paired linear projections 604 functioning as spacers.

In embodiment examples E8 and E9, speakers were produced with the same procedure as described above with the structures 600*b* and 600*c*, respectively.

In embodiment examples E10, E11, and E12, speakers were produced with the same procedure as described above with the structures 600*a*, 600*b* and 600*c*, respectively, and a diaphragm having slits. The slits were formed along the opposed edges of the diaphragm at respective positions contacting with the linear projections 604, such as a position S illustrated in FIG. 19B. In embodiment example E13, a speaker was produced by further providing a protective sheet on a diaphragm having slits, superimposing the opposed ends of the protective sheet on each other on the band-shaped projection 606, and fixing the opposed ends of the protective sheet with screws. The protective sheet employed here is a porous fluorine film, i.e., an sa-PTFE vent filter manufactured by NIPPON Valqiua Industries, Ltd.

TABLE 4 given below summarizes conditions for producing the above-described speakers.

TABLE 4

| | shape of base | magnet | slits in diaphragm | protective sheet |
|---|---|---|---|---|
| E7 | bobbin with linear projections extending around entire circumference | externally attached | absent | absent |
| E8 | bobbin with 10 mm-long linear projections | externally attached | absent | absent |
| E9 | bobbin with 5 mm-long linear projections | externally attached | absent | absent |

TABLE 4-continued

| | shape of base | magnet | slits in diaphragm | protective sheet |
|---|---|---|---|---|
| E10 | bobbin with linear projections extending around entire circumference | externally attached | present | absent |
| E11 | bobbin with 10 mm-long linear projections | externally attached | present | absent |
| E12 | bobbin with 5 mm-long linear projections | externally attached | present | absent |
| E13 | bobbin with linear projections extending around entire circumference | externally attached | present | present |

Figure 20A:
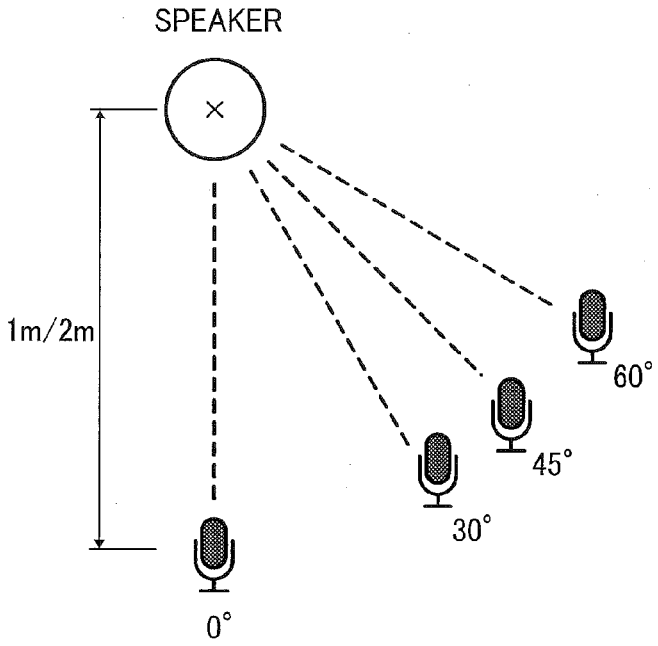
FIGS. 20A and 20B are diagrams illustrating conditions of an experiment for evaluating directivity characteristics.
Figure 20B:
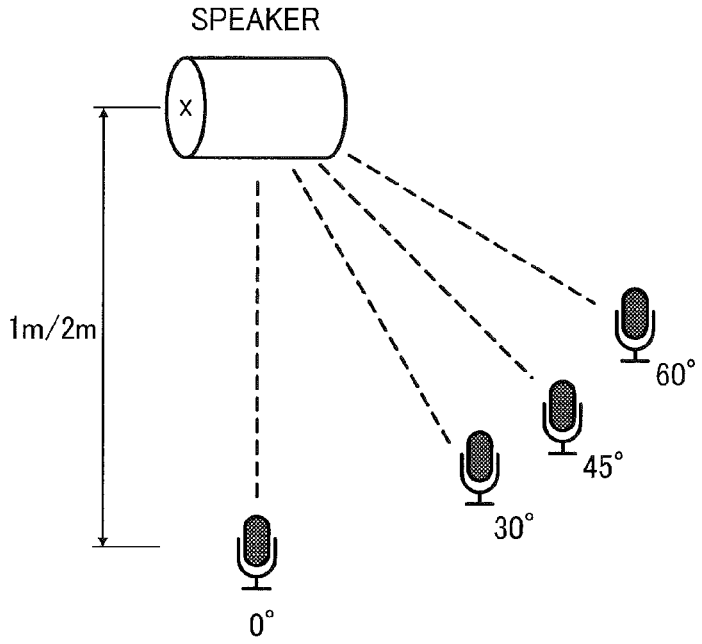
Figure 21A:
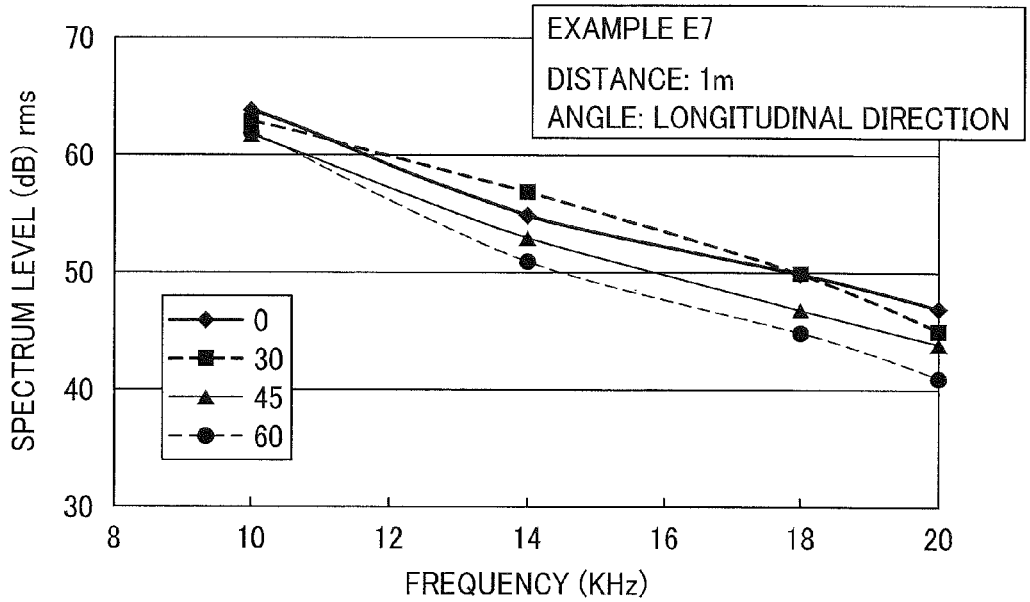
FIGS. 21A to 21D are diagrams illustrating experimental results of an embodiment example of this disclosure.
Figure 21B:
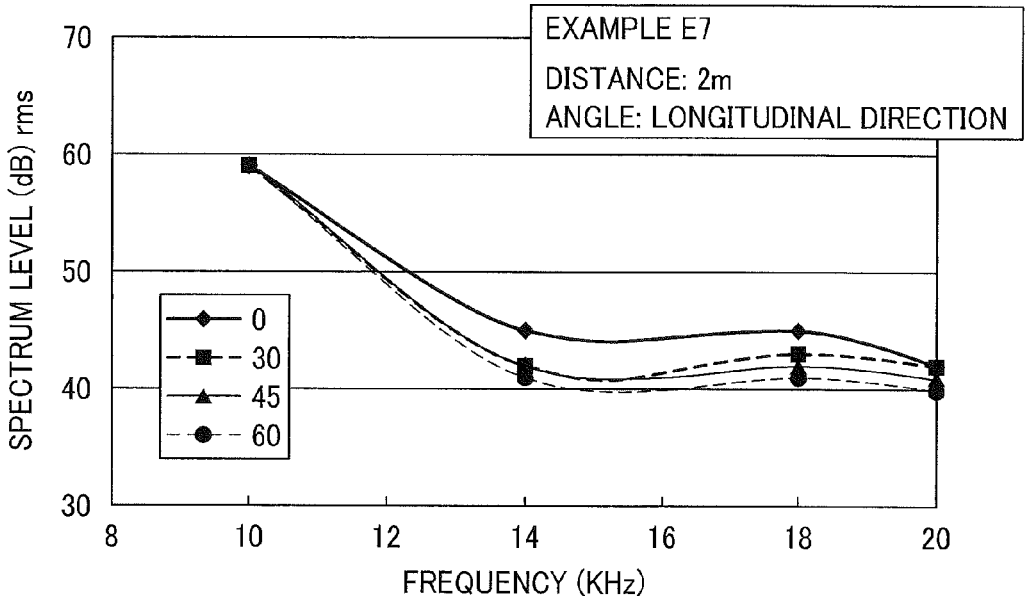
Figure 21C:
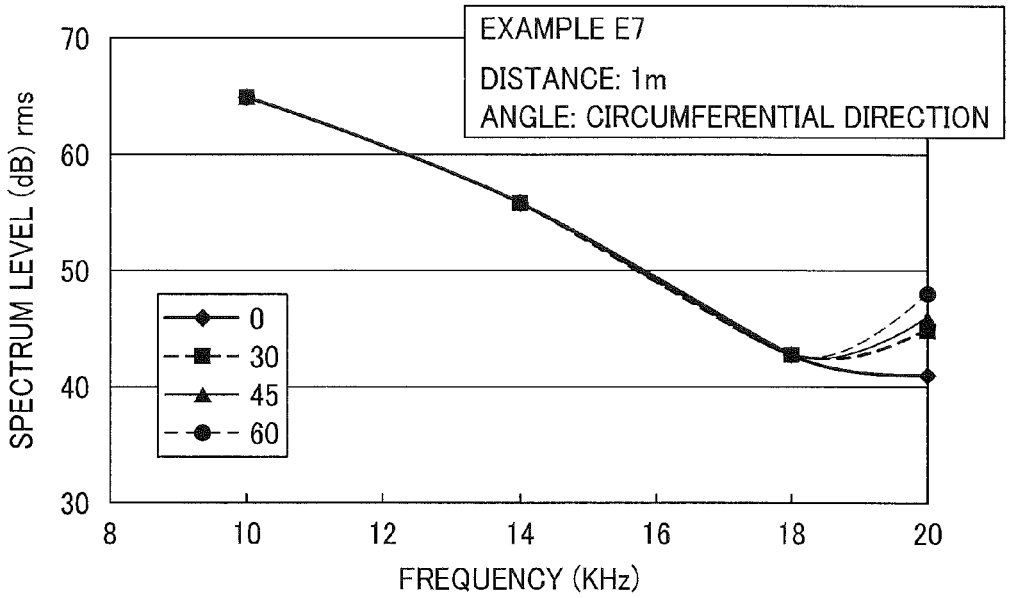
Figure 21D:
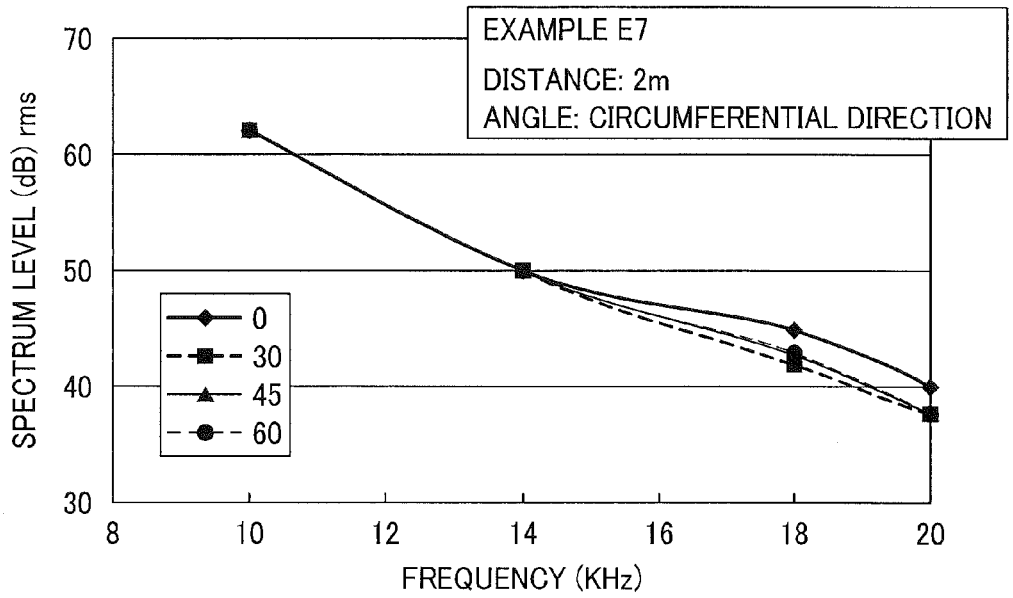
Figure 22A:
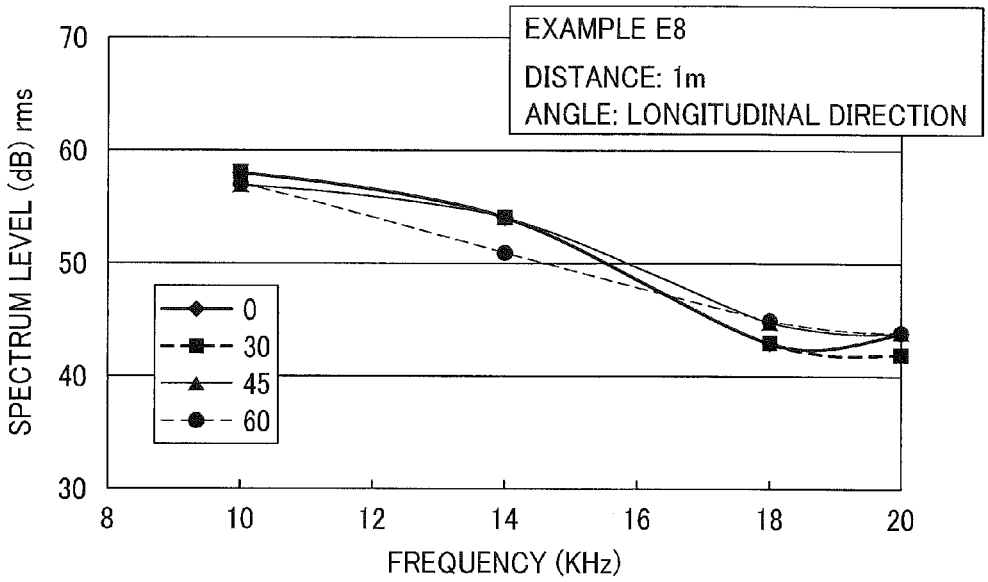
FIGS. 22A to 22D are diagrams illustrating experimental results of an embodiment example of this disclosure.
Figure 22B:
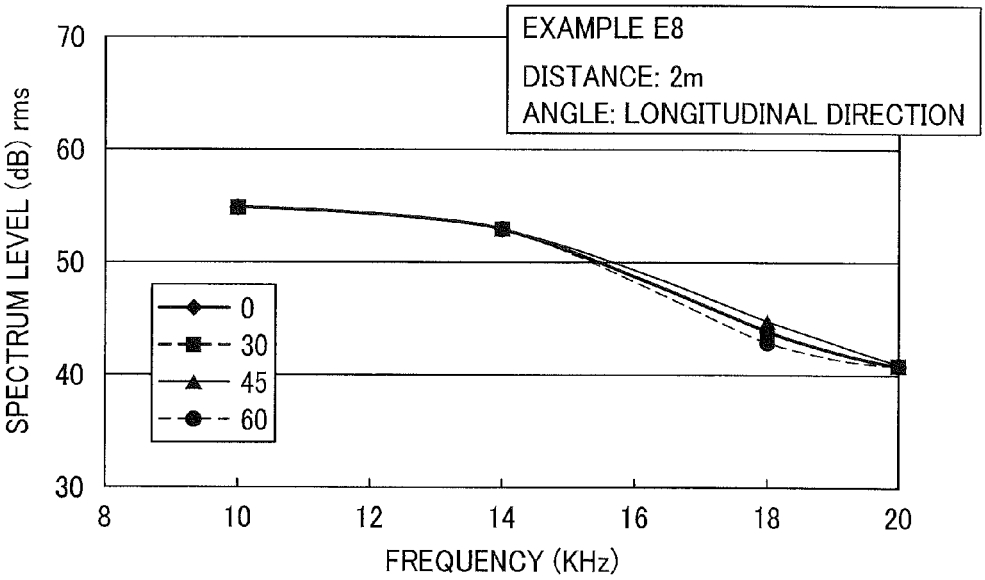
Figure 22C:
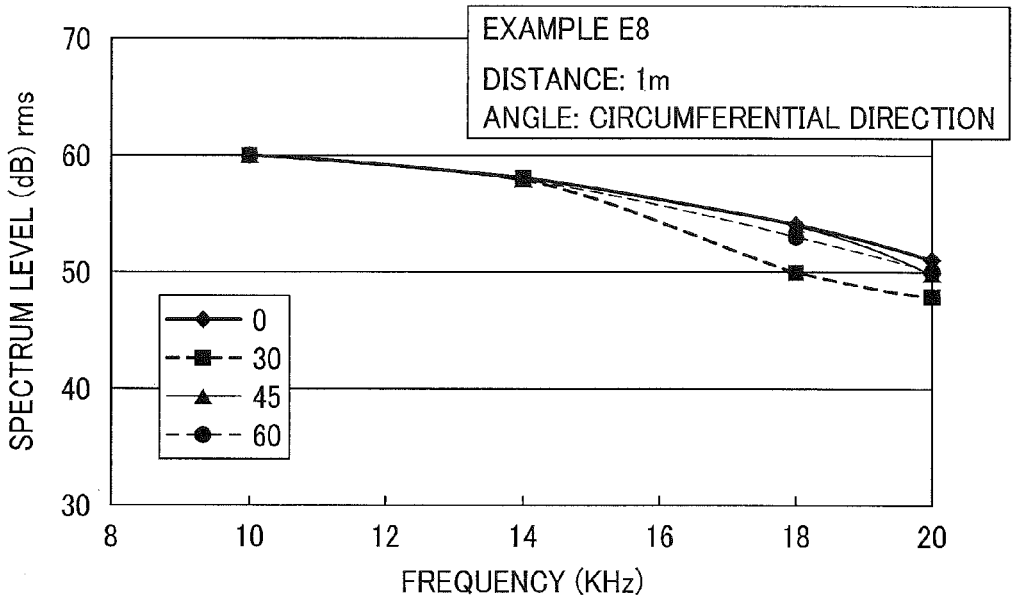
Figure 22D:
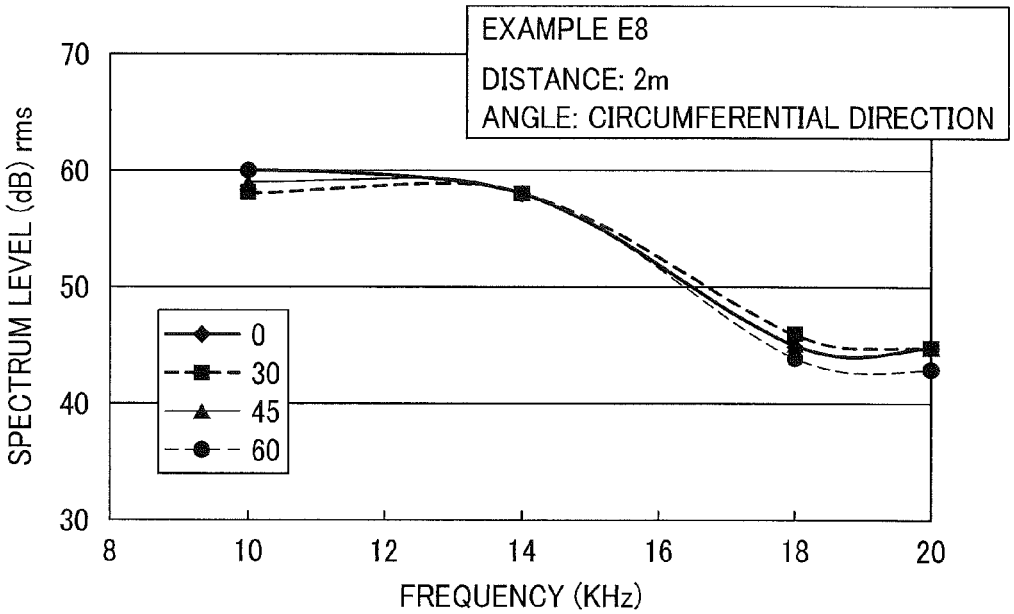
Figure 23A:
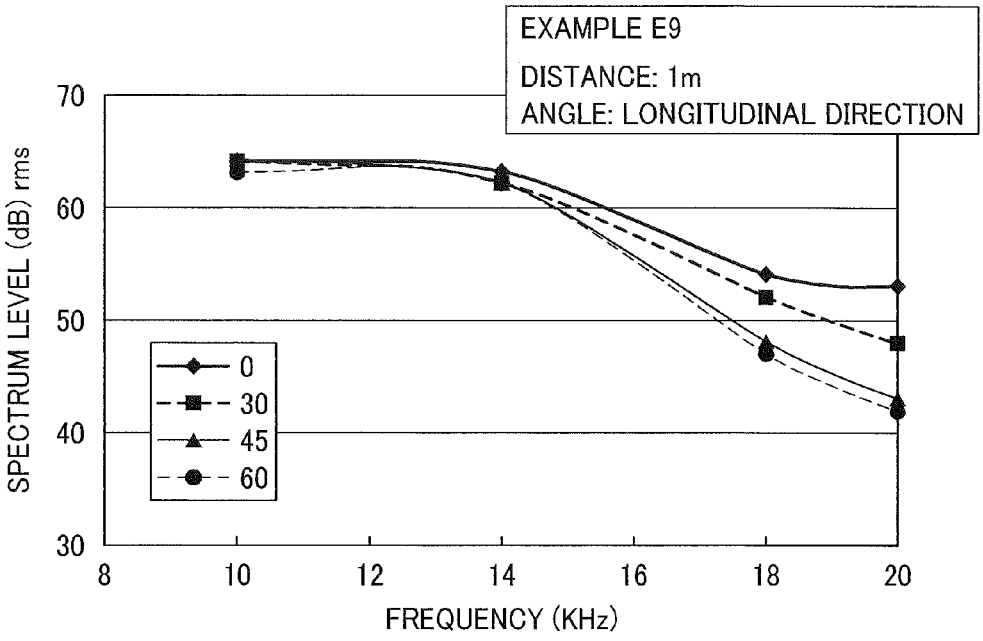
FIGS. 23A to 23D are diagrams illustrating experimental results of an embodiment example of this disclosure.
Figure 23B:
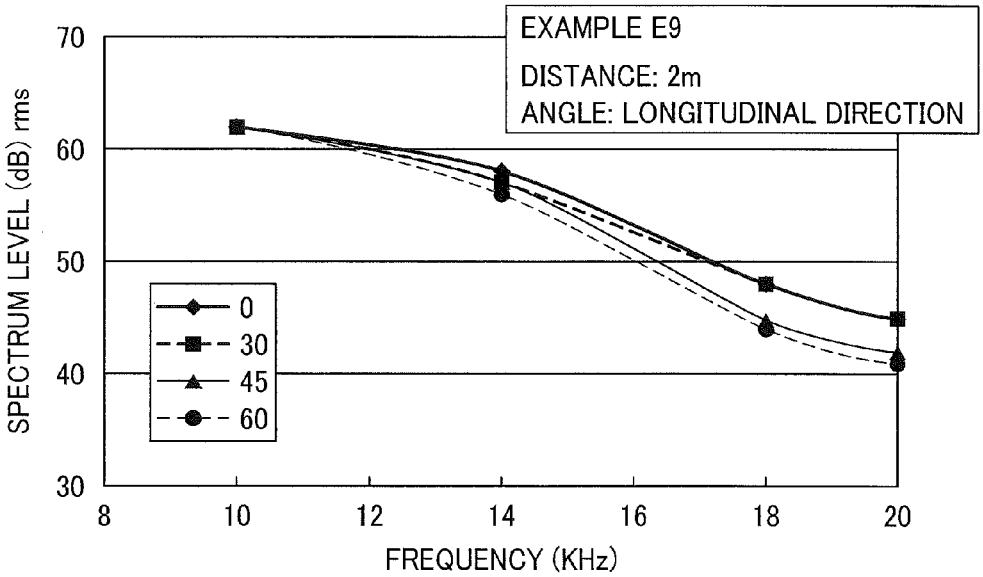
Figure 23C:
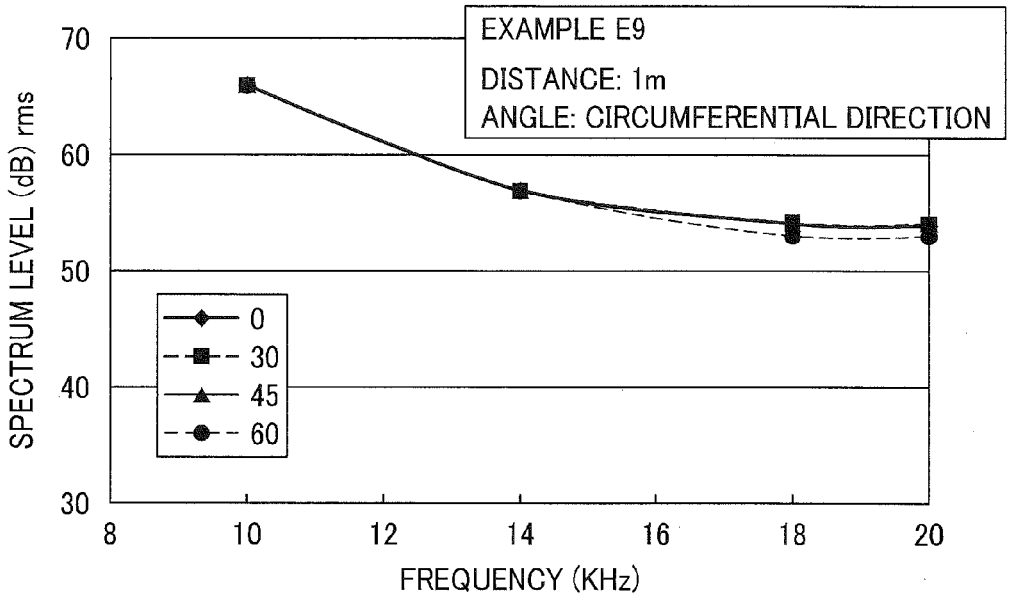
Figure 23D:
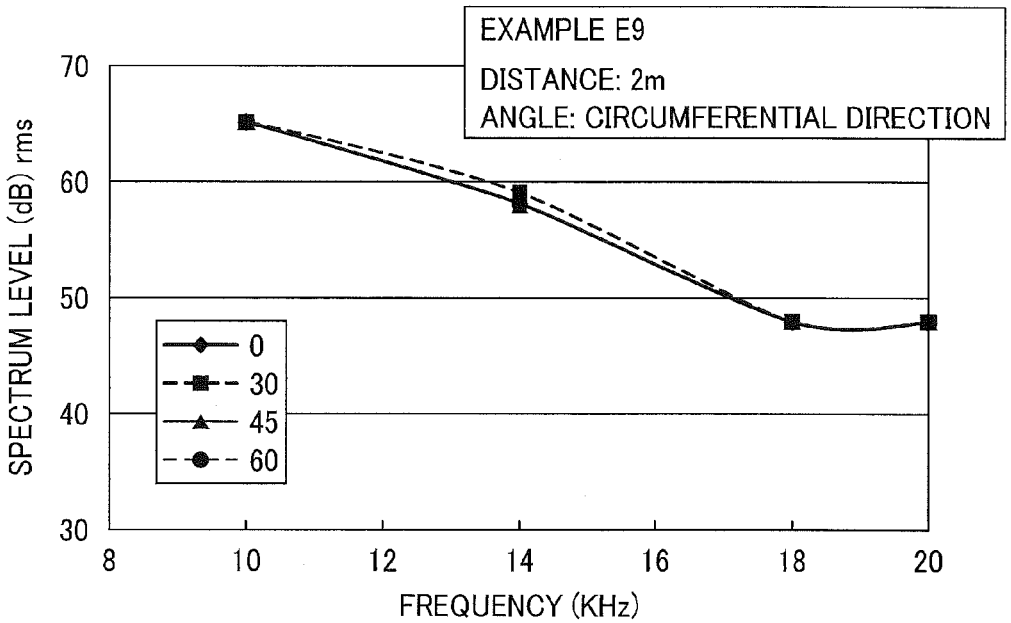
Figure 24A:
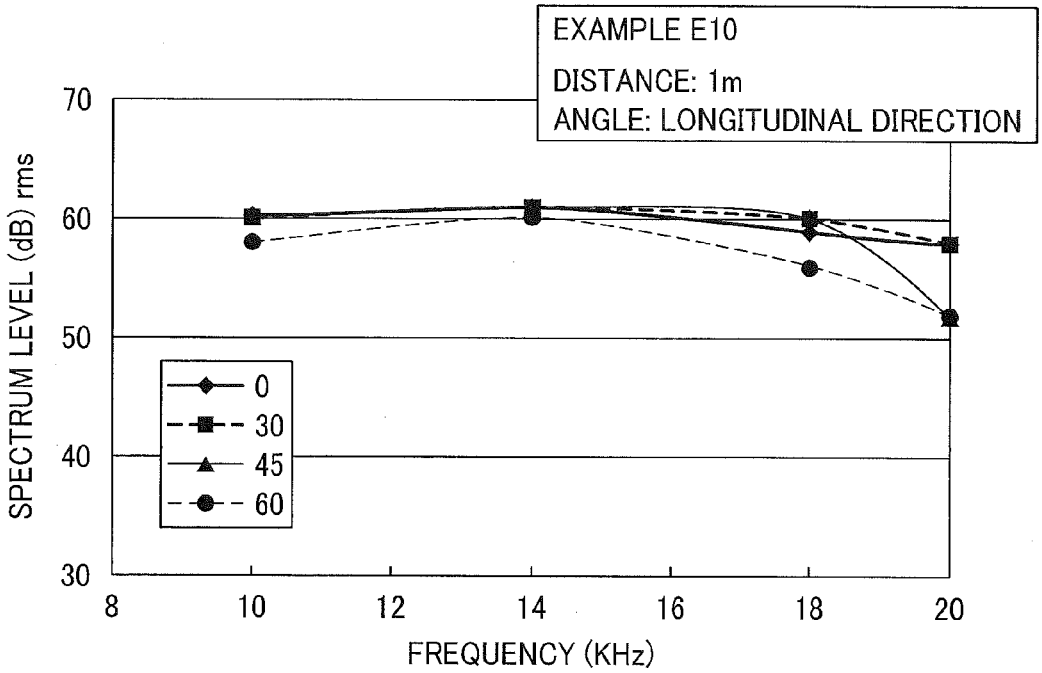
FIGS. 24A to 24D are diagrams illustrating experimental results of an embodiment example of this disclosure.
Figure 24B:
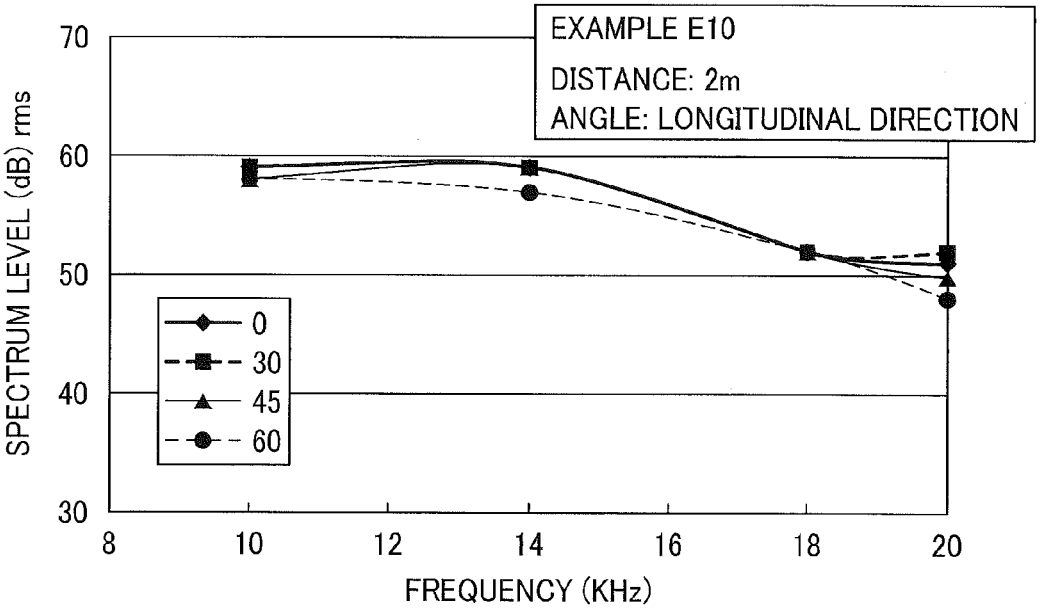
Figure 24C:
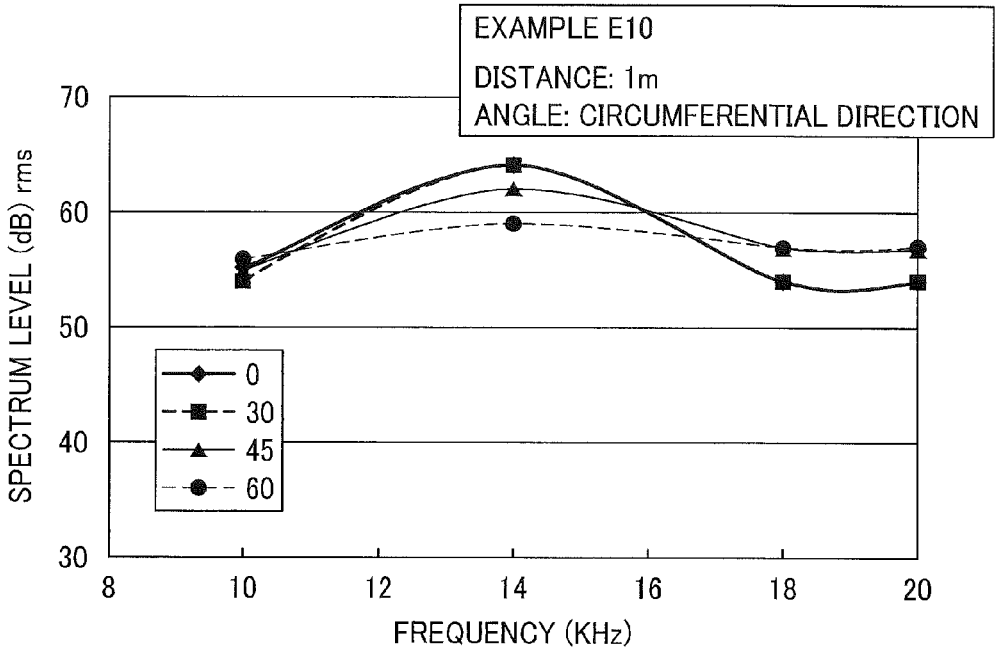
Figure 24D:
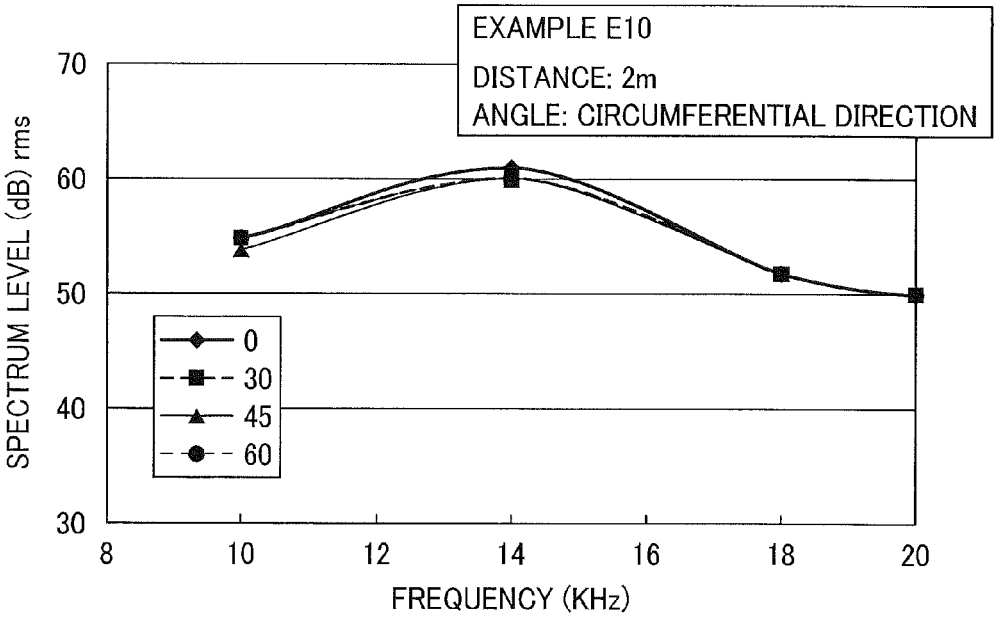
Figure 25A:
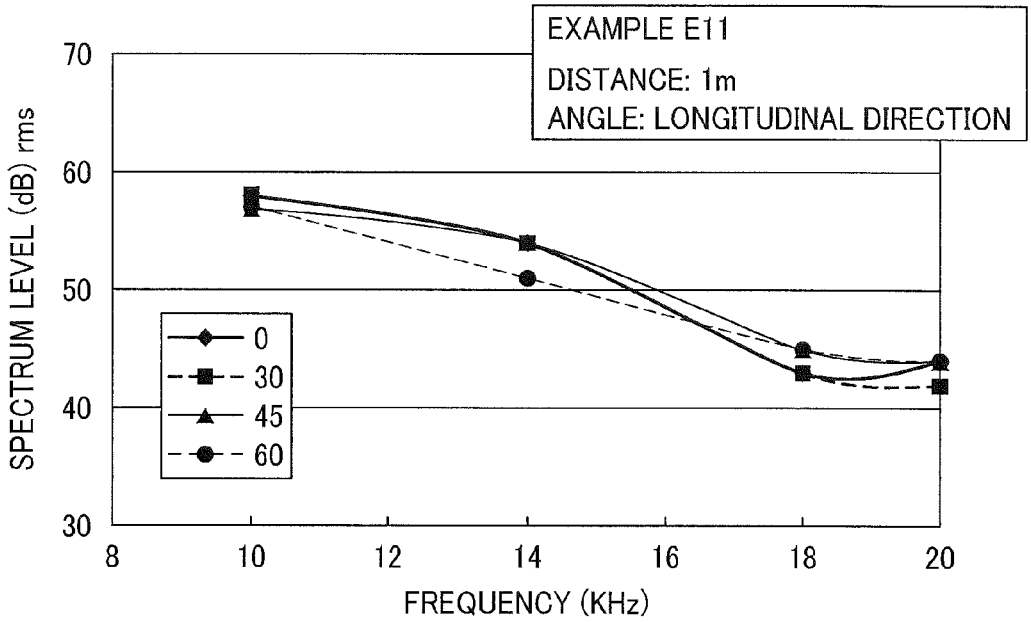
FIGS. 25A to 25D are diagrams illustrating experimental results of an embodiment example of this disclosure.
Figure 25B:
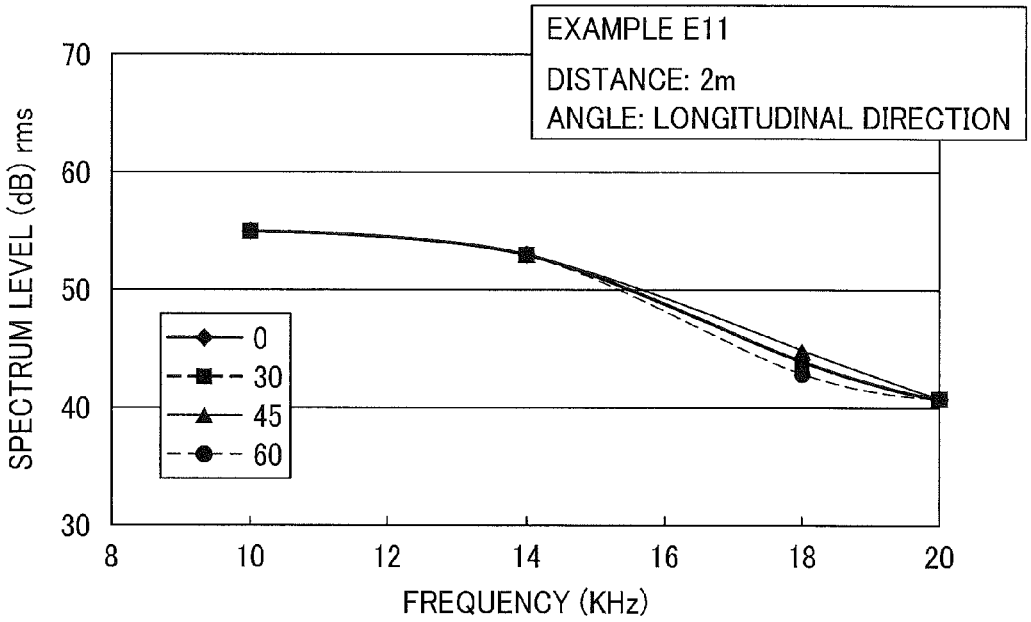
Figure 25C:
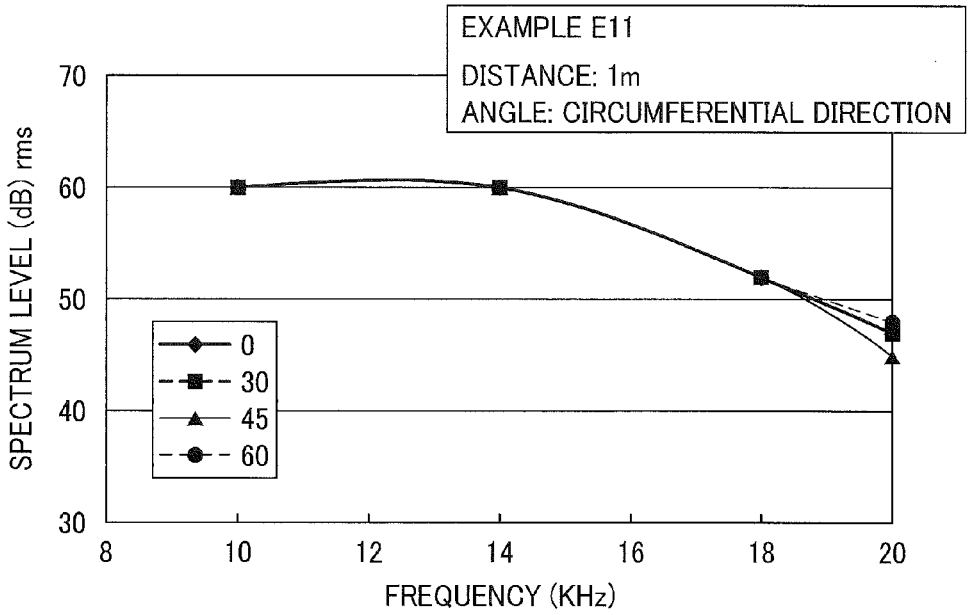
Figure 25D:
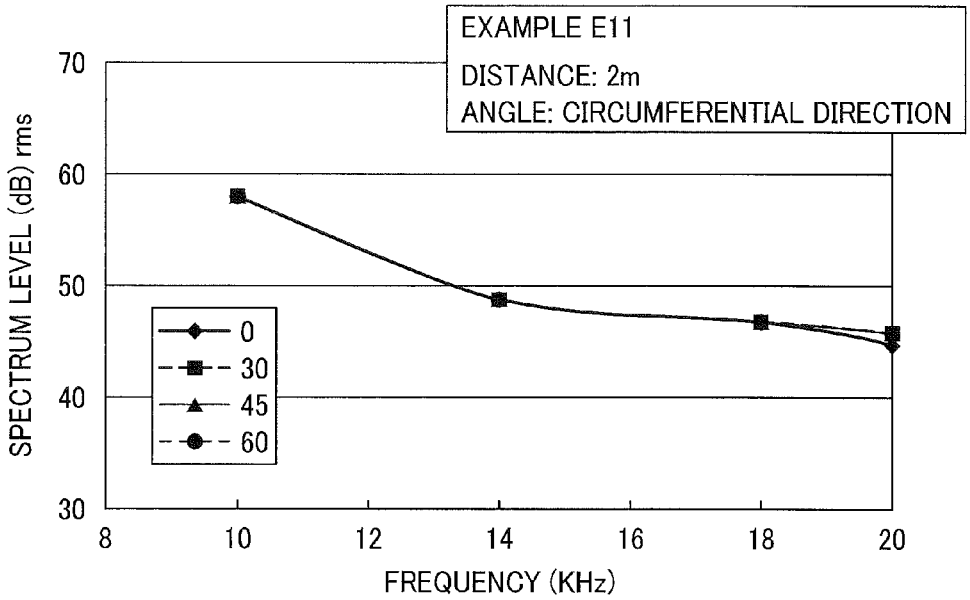
Figure 26A:
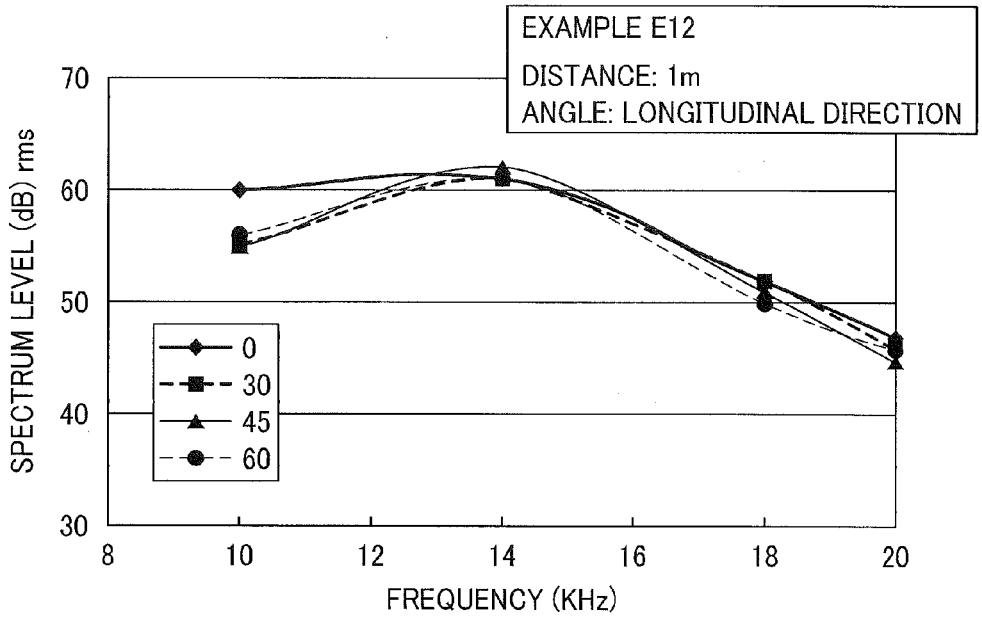
FIGS. 26A to 26D are diagrams illustrating experimental results of an embodiment example of this disclosure.
Figure 26B:
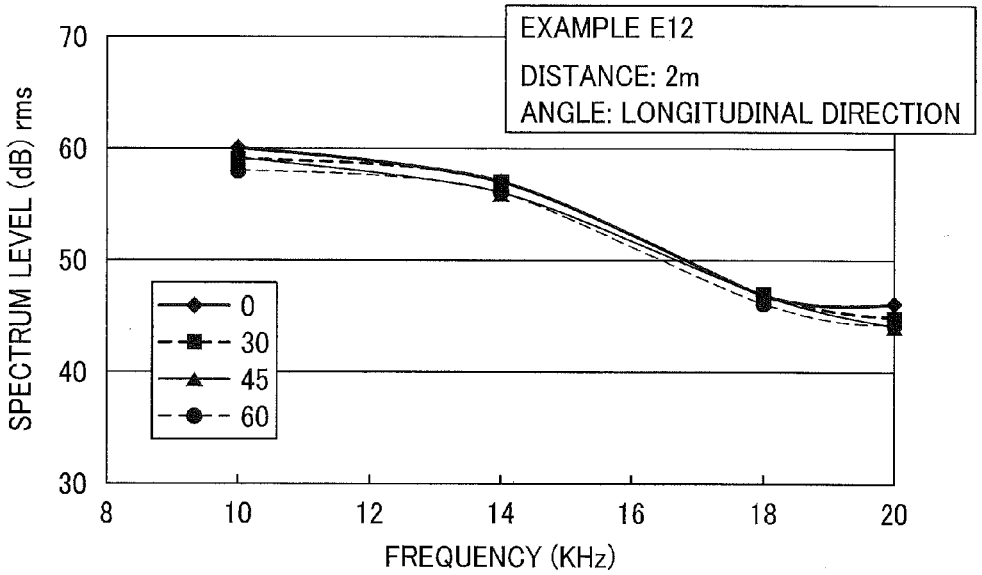
Figure 26C:
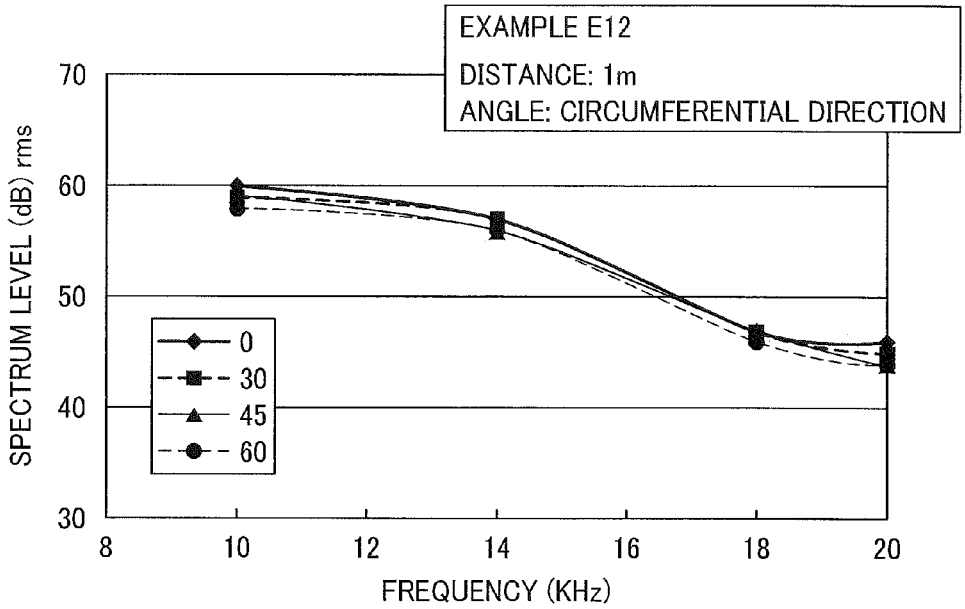
Figure 26D:
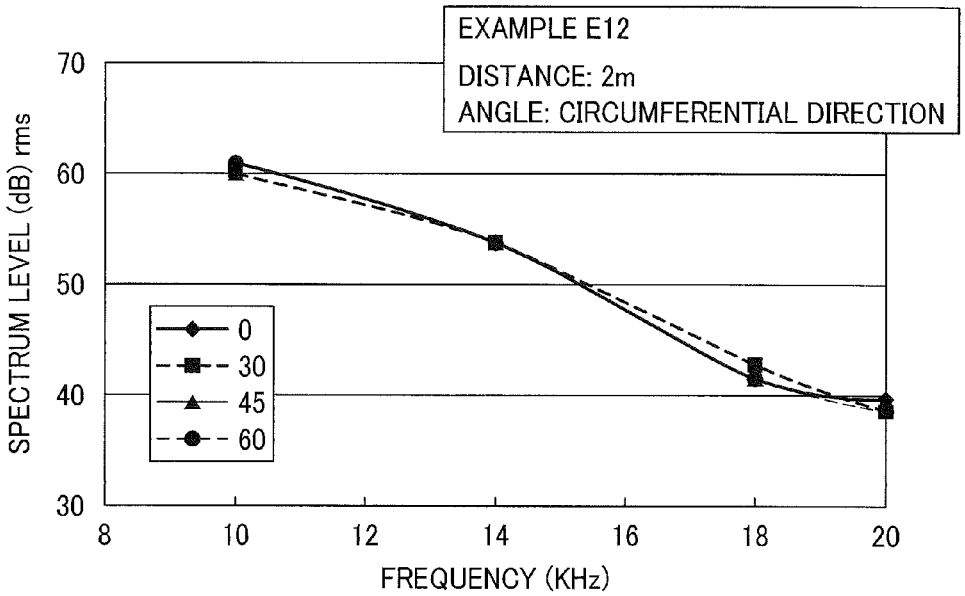

In the evaluation of directivity, the sound output from each of the speakers produced in the above-described procedures was measured to evaluate the directivity of the speaker. In the present experiment, the distance between the speaker and the microphone was set to 1 m and 2 m, and four types of sounds, i.e., sound at 10 KHz, sound at 14 KHz, sound at 18 KHz, and sound at 20 KHz, were output from the speaker and measured with the sound pressure measuring software at four measurement positions illustrated in FIG. 20A indicated as relative angles 0°, 30°, 45°, and 60° in the circumferential direction of the speaker relative to the reference line passing through the center of the speaker and four measurement positions illustrated in FIG. 20B indicated as relative angles 0°, 30°, 45°, and 60° in the longitudinal direction of the speaker relative to the reference line passing through the center of the speaker.

FIGS. 21A to 26D illustrate measurement results of embodiment examples E7 to E12. Measurement results of embodiment example E13 have been found to be substantially the same in value as the measurement results of embodiment example E10 except for the sound pressure at 20 KHz being lower than that of embodiment example E10 by 2 dB. Thus, illustration of the measurement results of embodiment example E13 is omitted here.

It has been found from the measurement results illustrated in FIGS. 21A to 26D that there is no substantial change in the measured sound pressure (dB) with the increase of the relative angle in embodiment examples E7 to E13.

Further, a speaker including a structure having a quadrangular pyramid shape and a speaker including a structure having a truncated quadrangular pyramid shape were produced, and an experiment was conducted to evaluate the directivity of the speakers.

Figure 27A:
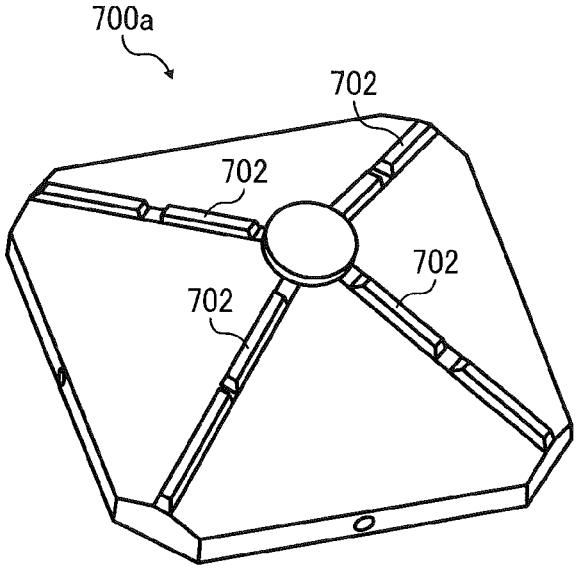
FIGS. 27A to 27C are diagrams illustrating structures and a diaphragm forming speakers according to embodiment examples of this disclosure.
Figure 27B:
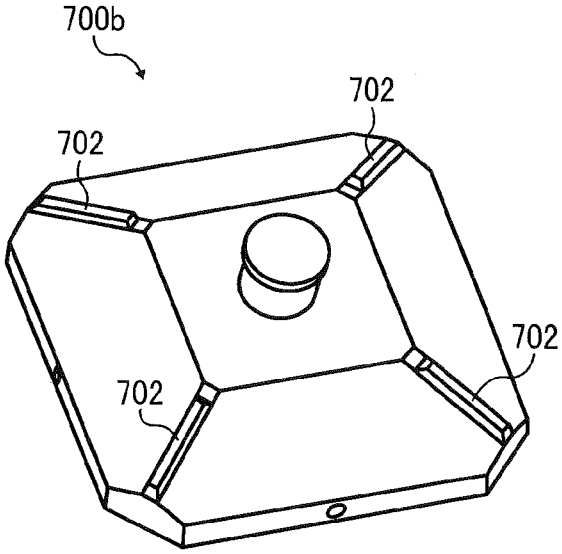

In the production of the speakers, a structure 700*a* having a substantially quadrangular pyramid shape illustrated in FIG. 27A and a structure 700*b* having a substantially truncated quadrangular pyramid shape illustrated in FIG. 27B were produced of an acrylonitrile-butadiene-styrene (ABS) resin. In each of the structures 700*a* and 700*b*, linear projections 702 functioning as spacers are formed at positions corresponding to the ridge lines of the pyramid.

Figure 27C:
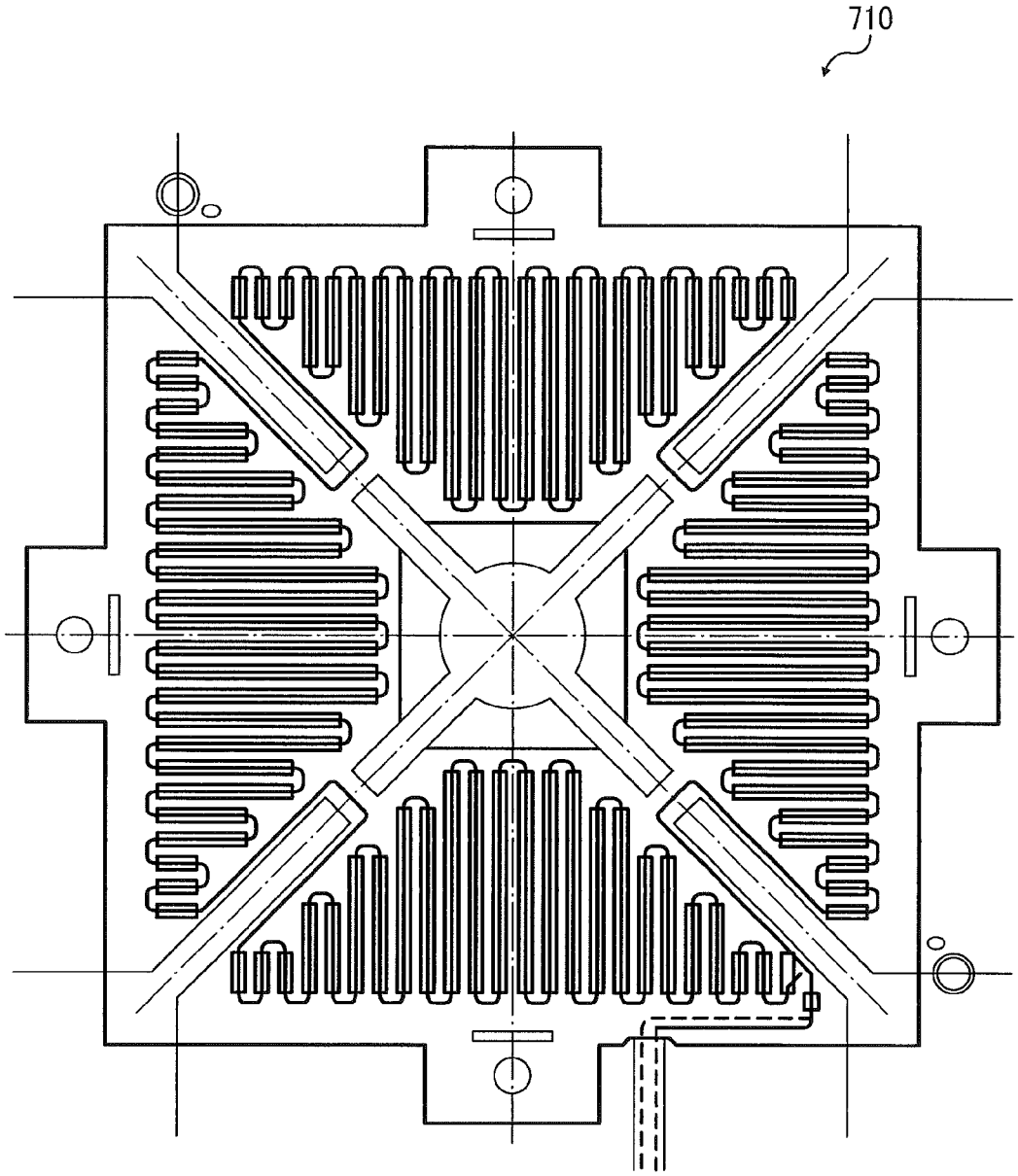

In embodiment example E14, a speaker was produced by embedding and fixing a bonded neodymium magnet having a leakage magnetic field of ±100 gauss, a thickness of 1 mm, and a pitch of 3 mm in four triangular pyramidal surfaces of the above-produced structure 700*a*, and disposing a diaphragm 710 illustrated in FIG. 27C to cover the magnet. The diaphragm employed here is a 20 μm-thick polyimide resin film having a coil of a copper pattern having a thickness of 9 μm and a pitch of 3 mm formed in both surfaces. In embodiment example E15, a speaker was produced in a similar procedure as described above by externally attaching and fixing the bonded neodymium magnet on four trapezoidal pyramidal surfaces of the above-produced structure 700*b*, and disposing the diaphragm 710 to cover the magnet.

TABLE 5 given below summarizes conditions for producing the above-described speakers.

TABLE 5

| | shape of base | magnet | slits in diaphragm | protective sheet |
|---|---|---|---|---|
| E14 | quadrangular pyramid | embedded | absent | absent |
| E15 | truncated quadrangular pyramid | externally attached | absent | absent |

In the evaluation of directivity, the sound output from each of the speakers produced in the above-described procedures was measured to evaluate the directivity of the speaker. In the present experiment, the distance between the speaker and the microphone was set to 1 m and 2 in, and four types of sounds, i.e., sound at 10 KHz, sound at 14 KHz, sound at 18 KHz, and sound at 20 KHz, were output from the speaker and measured with the sound pressure measuring software at the four measurement positions illustrated in FIG. 20A indicated as the relative angles 0°, 30°, 45°, and 60° to the reference line passing through the center of the speaker.

Figure 28A:
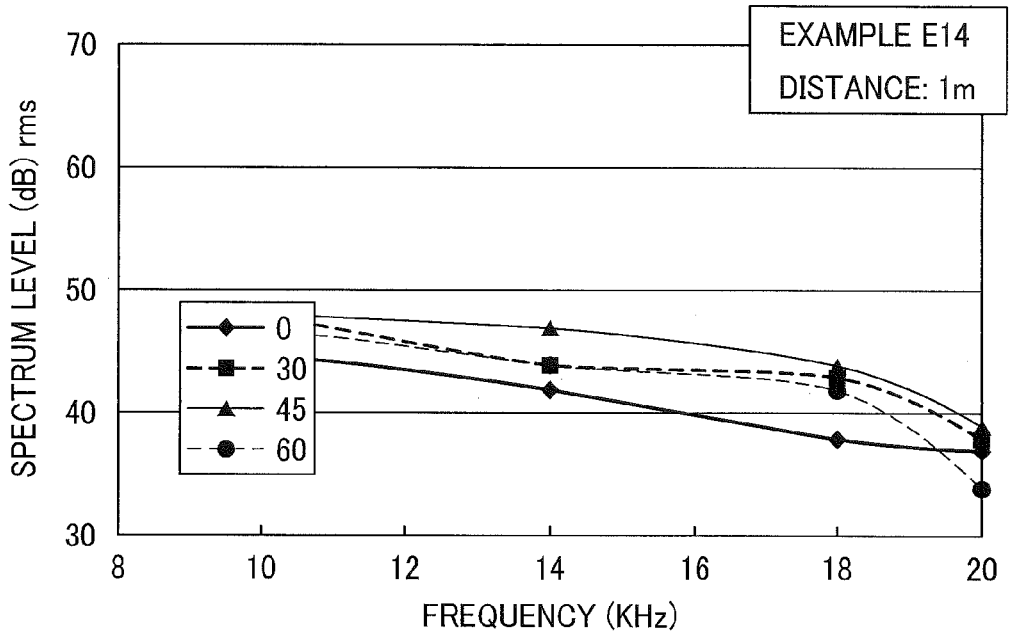
FIGS. 28A to 28D are diagrams illustrating experimental results of embodiment examples of this disclosure.
Figure 28B:
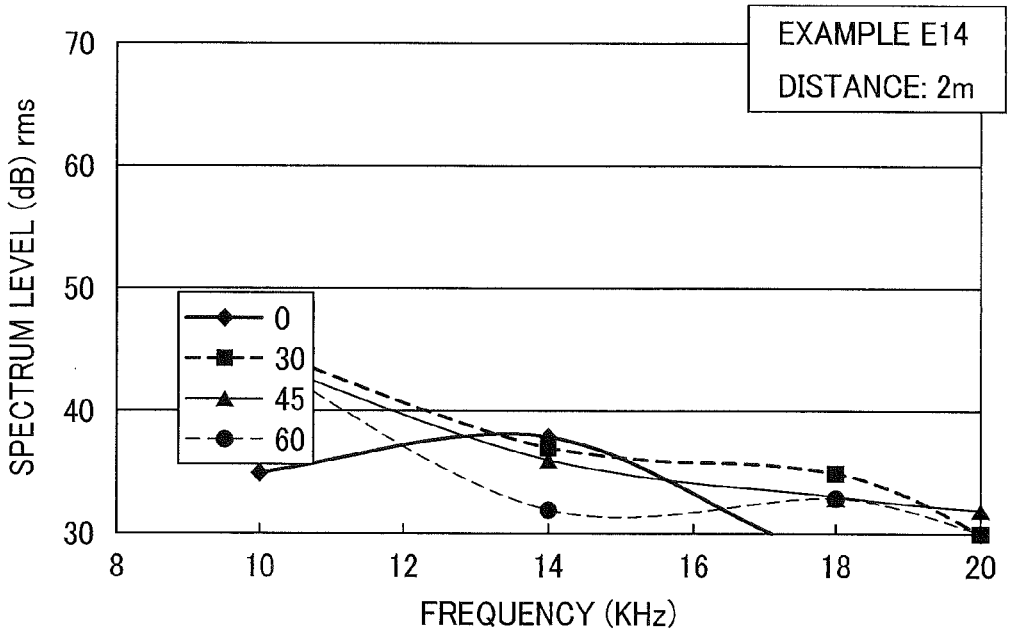
Figure 28C:
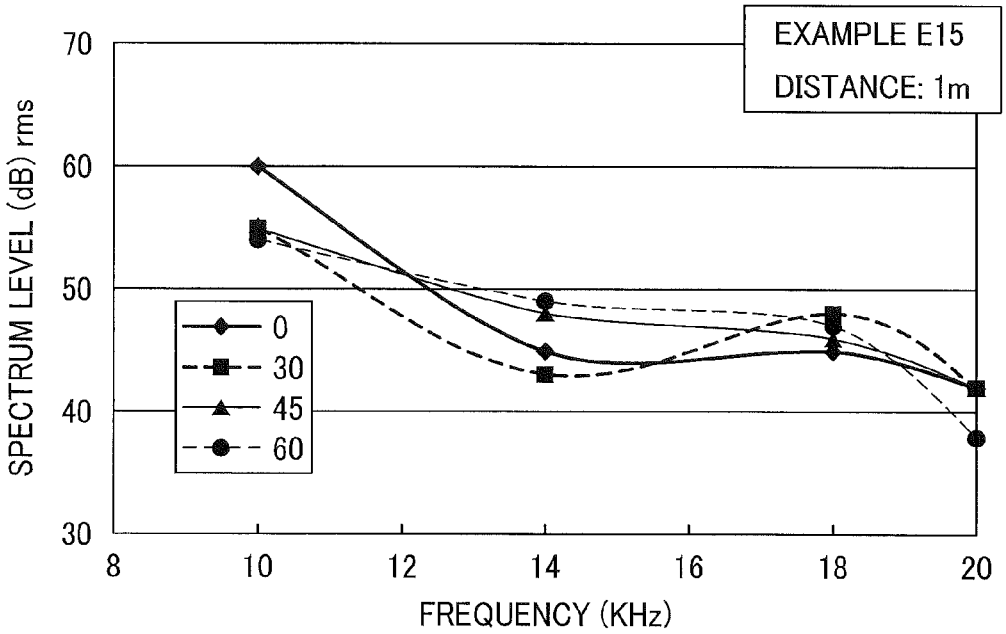
Figure 28D:
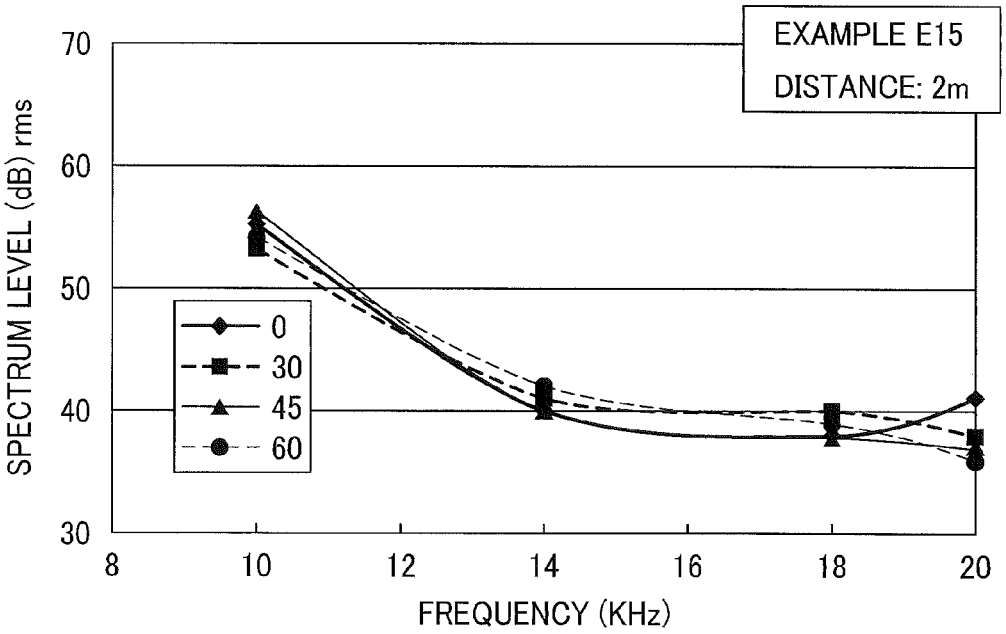

FIGS. 28A and 28B illustrate measurement results of embodiment example E14. FIGS. 28C and 28D illustrate measurement results of embodiment example E15. It has been found from the measurement results illustrated in FIGS. 28A to 28D that there is no substantial change in the measured sound pressure (dB) with the increase of the relative angle in embodiment examples E14 and E15.

Further, a band-shaped speaker was produced in the procedure described with reference to FIGS. 13A to 13E, and an experiment was conducted to evaluate the directivity of the speaker.

In the production of the speaker, a flame-retardant sheet, specifically a flame-retardant conductor pattern film manufactured by Seiren Co., Ltd., was prepared as a sheet member and cut in a rectangle having a width of 40 mm, a length of 165 mm, and a thickness of 165 Then, a bonded neodymium magnet having a leakage magnetic field of ±100 gauss, a width of 25 mm, a length of 90 mm, a thickness of 1 mm, and a pitch of 3 mm was disposed on the flame-retardant sheet and fixed thereto with a double-sided adhesive tape made of a flame-retardant acrylic material and manufactured by 3M Company to prevent the bonded neodymium magnet from moving. Then, a non-magnetic rubber sheet the same in size as the bonded neodymium magnet was placed on the bonded neodymium magnet. Thereafter, a polyimide resin film having a width of 25 mm, a length of 110 mm, and a thickness of 20 μm with a coil of a copper pattern having a thickness of 9 μm and a pitch of 3 mm formed in both surfaces was prepared as the diaphragm and positioned on the rubber sheet by the method described with reference to FIGS. 14A to 14D. Further, a sheet having a water-repellent treated surface is disposed on the diaphragm to cover the diaphragm, and outer edges of the sheet having the water-repellent surface were fixed to the flame-repellant sheet with a double-sided adhesive tape. Finally, a 40 mm×25 mm piece of hook-and-loop fastener New ECOMAGIC Heat Resistant Type manufactured by Morito Co., Ltd. was attached to the front and rear surfaces of a laminate of the magnet, the diaphragm, and the sheets described above in the manner illustrated in FIGS. 16A and 16B, to thereby obtain a band-shaped speaker.

In the evaluation of the directivity of the speaker manufactured in the above-described procedure, the sound output from the speaker with the male and female surfaces of the hook-and-loop fastener stuck to each other was measured to examine the directivity of the speaker. In this experiment, the distance between the speaker and the microphone was set to 1 m and 2 m, and four types of sounds, i.e., sound at 10 KHz, sound at 14 KHz, sound at 18 KHz, and sound at 20 KHz, were output from the speaker and measured with the sound pressure measuring software at the four measurement positions illustrated in FIG. 20A indicated as the relative angles 0°, 30°, 45°, and 60° in the circumferential direction of the speaker to the reference line passing through the center of the speaker and the four measurement positions illustrated in FIG. 20B indicated as the relative angles 0°, 30°, 45°, and 60° in the longitudinal direction of the speaker to the reference line passing through the center of the speaker. Measurement results obtained thereby are substantially the same in value as the measurement results of embodiment example E10.

Figure 29A:
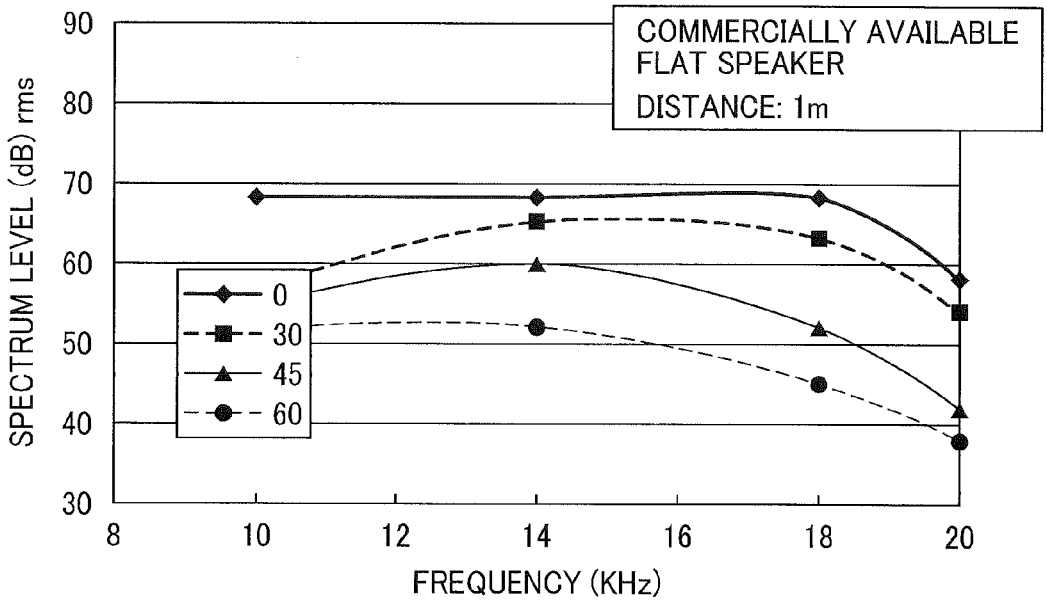
FIGS. 29A to 29D are diagrams illustrating experimental results of reference examples.
Figure 29B:
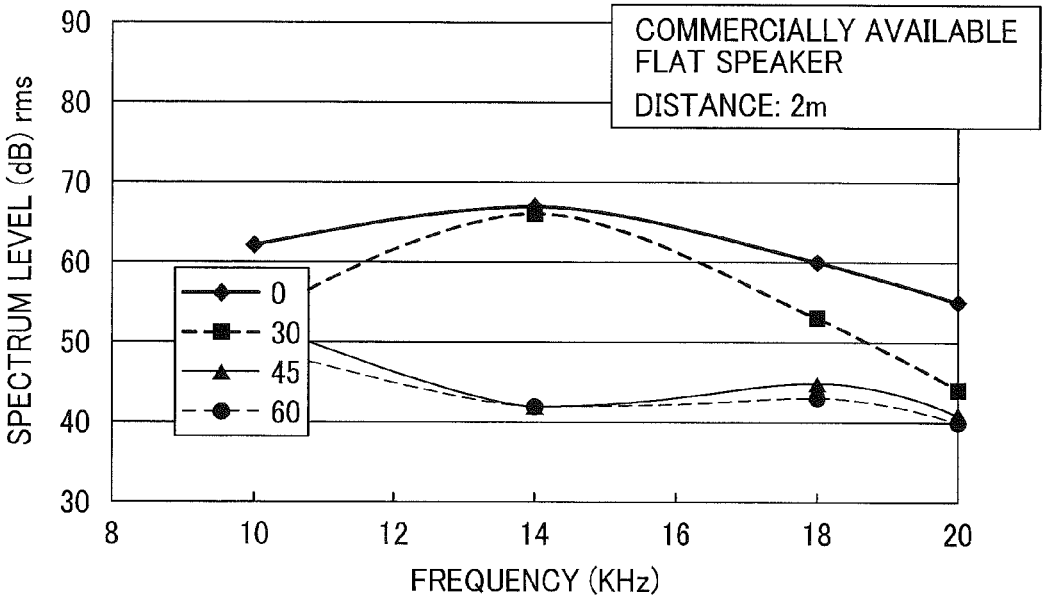
Figure 29C:
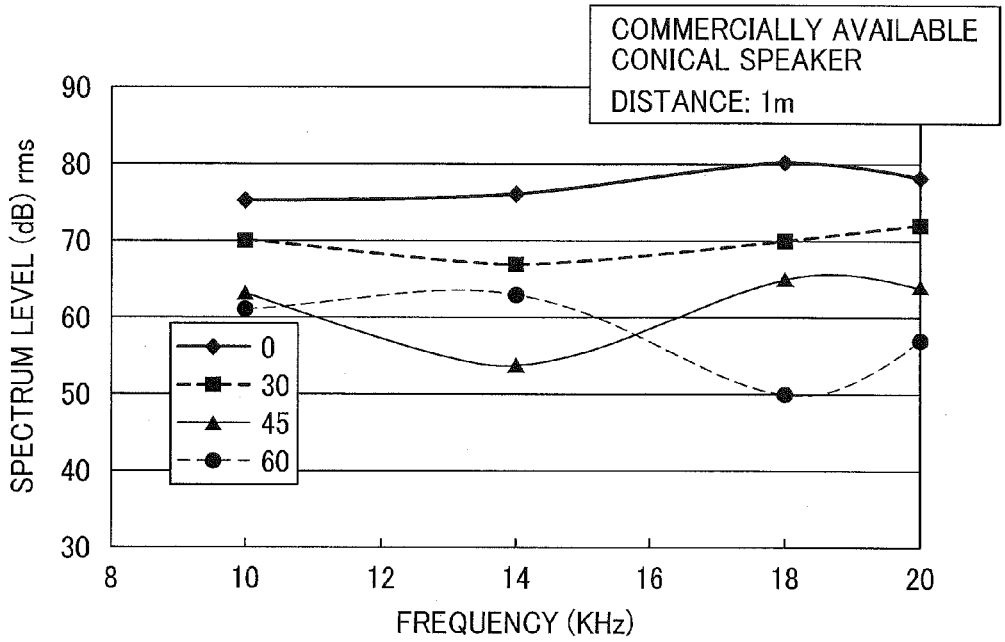
Figure 29D:
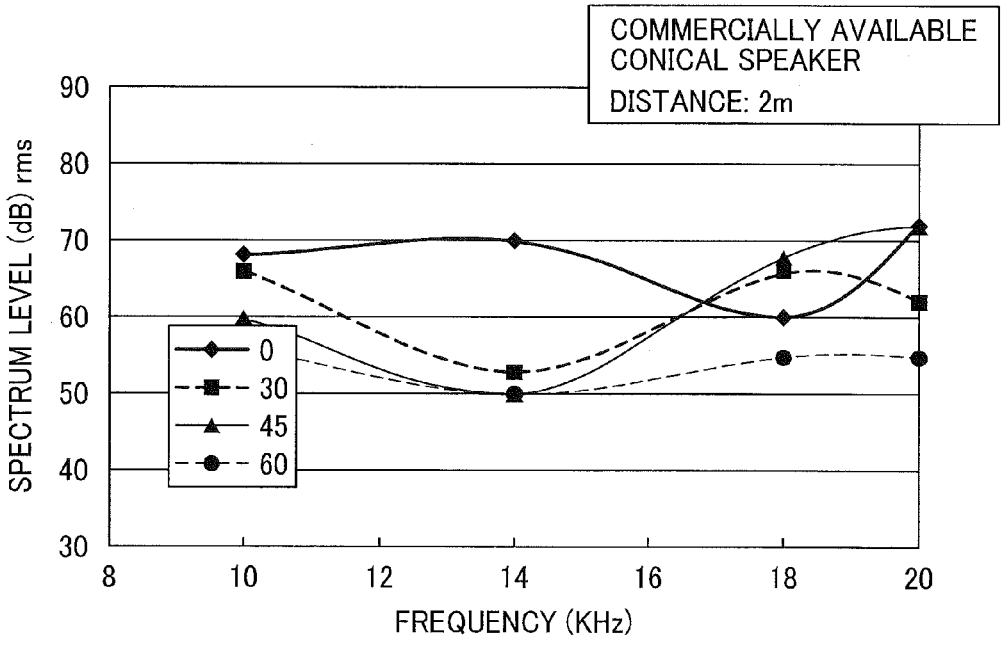

As reference examples, the directivity of a commercially available flat speaker and the directivity of a commercially available normal conical speaker were also examined under the same conditions as described above. FIGS. 29A and 29B illustrate measurement results of the commercially available flat speaker. FIGS. 29C and 29D illustrate measurement results of the commercially available normal conical speaker. As illustrated in FIGS. 29A to 29D, the sound pressure of the sound output from each of the commercially available speakers is substantially different depending on the relative angle.

It has been found from the above-described experimental results that the speakers according to embodiments of this disclosure are non-directional.

According to an embodiment of this disclosure, a novel energy converter attachable to a desired structure is provided. The energy converter according to an embodiment of this disclosure is applicable to speakers and microphones, for example.

The above-described embodiments are illustrative and do not limit this disclosure. Thus, numerous additional modifications and variations are possible in light of the above teachings. For example, elements or features of different illustrative and embodiments herein may be combined with or substituted for each other within the scope of this disclosure and the appended claims. Further, features of components of the embodiments, such as number, position, and shape, are not limited to those of the disclosed embodiments and thus may be set as preferred. Further, the above-described steps are not limited to the order disclosed herein. It is therefore to be understood that, within the scope of the appended claims, the disclosure of this disclosure may be practiced otherwise than as specifically described herein.

What is claimed is:

1. An energy converter comprising:

a permanent magnet fixed to an area of the converter; and a diaphragm disposed on the permanent magnet and having a coil formed of a conductor pattern;

the permanent magnet including a deformable magnetic sheet;

wherein the area of the converter is a non-flat surface; and wherein the permanent magnet is fixed around the non-flat surface.

2. The energy converter according to claim 1, further comprising:

spacers formed between the diaphragm and the permanent magnet to secure a range of motion of the diaphragm.

3. The energy converter according to claim 1, wherein the diaphragm has a surface facing the permanent magnet and having minute projections formed in dots.

4. The energy converter according to claim 1, further comprising:

a buffer film disposed between the diaphragm and the permanent magnet to secure a range of motion of the diaphragm.

5. The energy converter according to claim 1, wherein the conductor pattern is formed on both surfaces of the diaphragm.

6. The energy converter according to claim 1, wherein the area of the converter is one of a cylindrical curved surface and a spherical curved surface.

7. The energy converter according to claim 1, wherein the area of the converter is pyramidal surfaces of one of a pyramid and a truncated pyramid.

8. The energy converter according to claim 1, wherein the permanent magnet is a bonded magnet.

9. The energy converter according to claim 1, wherein the diaphragm includes a resin substrate.

10. The energy converter according to claim 1, further comprising:

a plastic substrate on which the permanent magnet is fixed;

a buffer film disposed between the permanent magnet and the diaphragm to secure a range of motion of the diaphragm; and a protective sheet covering the diaphragm and fixed to the plastic substrate.

11. The energy converter according to claim 10, wherein the protective sheet is water-repellant and sound-transmissive.

12. The energy converter according to claim 10, wherein the plastic substrate is flame-retardant.

13. The energy converter of claim 1, wherein the area of the converter is a curved surface.

14. A speaker comprising:

a permanent magnet fixed to an area of the speaker; and a diaphragm disposed on the permanent magnet and having a coil formed of a conductor pattern;

the permanent magnet including a deformable magnetic sheet;

wherein the area of the speaker is a non-flat surface; and wherein the permanent magnet is fixed around the non-flat surface.

15. The speaker according to claim 14, further comprising:

a plastic substrate on which the permanent magnet is fixed;

a buffer film disposed between the permanent magnet and the diaphragm to secure a range of motion of the diaphragm; and a protective sheet covering the diaphragm and fixed to the plastic substrate.

16. The speaker of claim 14, wherein the area of the speaker is a curved surface.

17. A method of manufacturing an energy converter, the method comprising:

fixing a permanent magnet to an area of the converter; and disposing on the permanent magnet a diaphragm having a coil formed of a conductor pattern, including:

placing a magnetic sheet encapsulated with a magnetic fluid on the diaphragm to visualize a magnetization pattern of the permanent magnet disposed under the diaphragm as a shading pattern of the magnetic fluid, and adjusting the diaphragm in position and disposing the diaphragm at a position at which the shading pattern matches the conductor pattern of the coil;

wherein the permanent magnet is fixed around the non-flat surface.

* * * * *